US008056536B2

(12) United States Patent
Nakauchi et al.

(10) Patent No.: US 8,056,536 B2
(45) Date of Patent: Nov. 15, 2011

(54) IGNITION DEVICE FOR INTERNAL COMBUSTION ENGINE

(75) Inventors: Kiyotada Nakauchi, Numazu (JP); Akira Shimoyama, Numazu (JP); Yasukazu Hatano, Numazu (JP); Masayuki Sugiyama, Numazu (JP)

(73) Assignee: Kokusan Denki Co., Ltd., Shizuoka-Ken (JP)

( * ) Notice: Subject to any disclaimer, the term of this patent is extended or adjusted under 35 U.S.C. 154(b) by 228 days.

(21) Appl. No.: 12/531,315

(22) PCT Filed: Mar. 17, 2008

(86) PCT No.: PCT/JP2008/054909

§ 371 (c)(1),
(2), (4) Date: Nov. 13, 2009

(87) PCT Pub. No.: WO2008/114780

PCT Pub. Date: Sep. 25, 2008

(65) Prior Publication Data

US 2010/0095932 A1 Apr. 22, 2010

(30) Foreign Application Priority Data

Mar. 19, 2007 (JP) ..... 2007-070605

(51) Int. Cl.
*F02P 3/08* (2006.01)
*F02P 5/15* (2006.01)

(52) U.S. Cl. ..... 123/406.57; 123/605; 123/618

(58) Field of Classification Search ..... 123/406.18, 123/406.23, 406.24, 406.53, 406.57, 406.6, 123/406.65, 599, 605, 618, 179.5, 406.54; 324/379–382, 388, 389, 391

See application file for complete search history.

(56) References Cited

U.S. PATENT DOCUMENTS 7,472,688 B2 * 1/2009 Nakauchi et al. ..... 123/406.53

FOREIGN PATENT DOCUMENTS

JP 2003-307171 A 10/2003
JP 2005-264732 A 9/2005
JP 2006-214339 A 8/2006

OTHER PUBLICATIONS

International Search Report for PCT/JP2008/054909.

* cited by examiner

*Primary Examiner* — Hai Huynh
(74) *Attorney, Agent, or Firm* — Pearne & Gordon LLP

(57) ABSTRACT

An ignition device for an internal combustion engine including: an exciter coil that generates an AC voltage having a positive half wave and first and second negative half waves generated before and after the positive half wave with rotation of the internal combustion engine; and an ignition control portion that controls an ignition position of the engine using a microprocessor to which a power supply voltage is supplied from a power supply circuit that converts the voltage having the negative half waves generated by the exciter coil to a DC voltage, wherein the ignition control portion is comprised so as to cause a timer to start a counting operation at the start of the operation of the microprocessor, regard a measurement value of the timer as time between generation of the first negative half wave and generation of the second negative half wave to arithmetically operate counting data for measuring the ignition position based on rotational speed information of the engine obtained from the time, and immediately measure the arithmetically operated counting data to generate an ignition signal.

18 Claims, 17 Drawing Sheets

Fig. 4A Exciter output voltage waveform

Fig. 4B (MPU) Power supply voltage Vcc waveform

Fig. 4C Exciter negative output pulse waveform

Fig. 4D Exciter positive output pulse waveform

Fig. 4E Ignition signal

θigi : ignition timing in idle time advance control
Tigi : time between CRn and ignition in idle time advance control
SNCHNE : start determination speed Idle_cnt : idle time advance control counter
IDLENUM : idle time advance control number set value
SNCHNE : start determination speed θigi : ignition timing in idle time advance control
Tigi : time between CRout and ignition in idle time advance control

IGNITION DEVICE FOR INTERNAL COMBUSTION ENGINE

TECHNICAL FIELD OF THE INVENTION

The present invention relates to a capacitor discharge ignition device for an internal combustion engine.

PRIOR ART OF THE INVENTION

A capacitor discharge ignition device for an internal combustion engine is comprised of an ignition coil, an ignition capacitor that is provided on a primary side of the ignition coil and charged to one polarity by an output of an ignition power supply, a discharge switch that conducts when receiving an ignition signal and discharges charges accumulated in the ignition capacitor through the primary coil of the ignition coil, and an ignition control portion that provides the ignition signal to the discharge switch in an ignition position of the internal combustion engine. As the ignition power supply, an exciter coil is often used provided in a magnet type AC generator mounted to the engine.

Recent internal combustion engine driven vehicles or internal combustion engine driven devices require complicated control of an ignition position (a crank angle position for an ignition operation) of the engine with respect to various control conditions including a rotational speed of the engine in order to reduce noises generated by the engine, clean exhaust gas, and allow efficient driving. Thus, in an internal combustion engine that places importance on cost reduction, an ignition device including an ignition control portion using a microprocessor has been used.

In controlling an ignition position using a microprocessor, information on a specific crank angle position of an engine is obtained by some method, a rotational speed of the engine is arithmetically operated based on the crank angle information, and the ignition position of the engine is arithmetically operated with respect to various control conditions including the arithmetically operated rotational speed. The information on a specific crank angle position is, for example, crank angle information indicating that a crank angle position of the engine matches a reference crank angle position having a certain relationship with a top dead center position (a crank angle position when a piston reaches a top dead center).

The ignition position of the engine is arithmetically operated as an angle from the reference crank angle position to the ignition position, or an advance angle from the top dead center of the engine to the ignition position. The angle that provides the arithmetically operated ignition position is converted to ignition position detecting counting data using the rotational speed of the engine at that time. The ignition position detecting counting data is time required for an engine to rotate from the reference crank angle position to the ignition position at the rotational speed of the engine at that time (time measured by a timer in the microprocessor). The ignition control portion recognizes that the crank angle position of the engine matches the reference crank angle position when a signal indicating the reference crank angle position is generated, sets the ignition position detecting counting data in an ignition position measuring timer (referred to as an ignition timer), and generates an ignition signal when the ignition timer completes measurement of the set counting data.

As a signal source for obtaining crank angle information of an engine, a pulser (a pulse signal generator) is used that generates a pulse signal in a reference crank angle position of the engine. In the case of placing importance on cost reduction, however, the pulser is sometimes required to be omitted.

An ignition device including no pulser is referred to as a pulserless type ignition device. As disclosed in, for example, Japanese Patent Application Laid-Open Publication No. 2003-307171, a pulserless type ignition device obtains crank angle information from an output voltage of an exciter coil provided in a magneto generator for charging an ignition capacitor. In the case of obtaining the crank angle information from the output voltage of the exciter coil, as shown in FIG. 20, a magneto generator is comprised so that the exciter coil generates an AC voltage once for one cylinder during one rotation of a crankshaft in forward rotation of an engine, the AC voltage having a half wave of a positive voltage $V_p$ with a sufficiently high peak value for charging the ignition capacitor, and a half wave of first and second negative voltages $V_{n1}$ and $V_{n2}$ generated before and after the positive voltage.

In the ignition device disclosed in Japanese Patent Application Laid-Open Publication No. 2003-307171, the second negative voltage $V_{n2}$ is set to be generated immediately before a top dead center position (a crank angle position when a piston of the engine reaches a top dead center) TDC of the engine, a crank angle position $\theta_{i0}$ at the time when the second negative voltage $V_{n2}$ passes the peak and then decreases to a set level $V_{s1}$ is used as an ignition position at the start, and a crank angle position $\theta_{i1}$ corresponding to the peak position of the second negative voltage $V_{n2}$ is used as an ignition position during idling. The positive voltage $V_p$ is compared with a set voltage $V_{s2}$, and a crank angle position at the time when the positive voltage $V_p$ becomes equal to the set voltage $V_{s2}$ is detected as a reference crank angle position $\theta_s$. In the reference crank angle position $\theta_s$, time data for calculating a rotational speed of the engine is captured, and measurement of the arithmetically operated ignition position is started. The reference crank angle position $\theta_s$ is set in a position further advanced from an ignition position at the time when an advance angle width becomes the maximum.

The microprocessor captures time measured by a timer for each detection of the reference crank angle position $\theta_s$, calculates time between the last detection of the reference crank angle position and this detection of the reference crank angle position (time required for one rotation of the crankshaft) as rotational speed detecting time data, and arithmetically operates the rotational speed of the engine from the time data. The microprocessor also arithmetically operates the ignition position of the engine with respect to control conditions including the arithmetically operated rotational speed, calculates time required for the engine to rotate from the reference crank angle position to the arithmetically operated ignition position at that rotational speed as ignition position detecting counting data, and sets the counting data in the ignition timer in the reference crank angle position to start measurement thereof.

In such a conventional ignition device, start time ignition control is performed at the start of the engine, and immediately after completion of the start of the engine is detected, the control is shifted to normal operation time ignition control. In the start time ignition control, an ignition signal is provided to a discharge switch to perform an ignition operation when the crank angle position corresponding to the ignition position at the start is detected, and the engine is started. The normal operation time ignition control is started when the rotational speed of the engine reaches a start determination speed or higher. In the normal operation time ignition control, the ignition signal is provided from an ignition control portion to the discharge switch in the crank angle position $\theta_{i1}$ to perform the ignition operation during idling of the engine, and the ignition signal is provided from the ignition control portion to the discharge switch in the ignition position arithmetically operated with respect to the control conditions such as the rotational speed of the engine to perform the ignition operation during operation of the engine other than idling.

Herein, the start time of the internal combustion engine means a transition period between the commencement of the start operation and the completion of the start of the engine allowing the engine to maintain rotation.

In the conventional pulserless type ignition device, the ignition position detecting counting data set in the ignition timer in the reference crank angle position $\theta_s$ in FIG. 20 is counting data arithmetically operated based on the rotational speed arithmetically operated from the rotational speed detecting time data measured one rotation before of the engine. In normal operation of the engine, the rotational speed of the crankshaft is stable, and thus there is no problem in using the ignition position detecting counting data calculated based on the rotational speed arithmetically operated from the rotational speed detecting time data measured one rotation before. However, at the start of the engine, the rotational speed of the crankshaft minutely varies with stroke changes of the engine, and thus when the ignition position detecting counting data is calculated based on the rotational speed arithmetically operated from the rotational speed detecting time data measured one rotation before of the engine, the ignition position at the start of the engine is improper, thereby inevitably preventing startability of the engine.

Thus, the applicant has proposed, in Japanese Patent Application Laid-Open Publication No. 2006-214339, a pulserless type ignition device for an internal combustion engine in which an ignition position can be determined based on rotational speed information of the engine calculated immediately before the ignition position at the start of the engine. In the proposed ignition device, when the internal combustion engine is at the start, time between detection of a first negative voltage and detection of a second negative voltage is measured in a generation position of the second negative voltage, information on a rotational speed of the engine obtained from the measured time is used to calculate ignition position detecting counting data at the start of the engine, and measurement of the counting data is immediately started to detect the ignition position at the start and generate an ignition signal.

In the proposed ignition device, the ignition position can be determined based on the rotational speed information of the engine calculated immediately before the ignition position at the start of the engine when the rotational speed of the crankshaft minutely varies. This can precisely determine the ignition position at the start to stabilize rotation of the engine, and improve startability of the engine.

However, in the ignition device proposed in Japanese Patent Application Laid-Open Publication No. 2006-214339, the rotational speed of the engine can be arithmetically operated only when the two negative voltages are generated after the commencement of the start operation of the engine. If the rotational speed cannot be arithmetically operated, the ignition signal cannot be generated. Thus, in the proposed ignition device, ignition sometimes cannot be performed in the first rotation of the crankshaft after the commencement of the start operation, which may reduce startability of the engine.

As disclosed in Japanese Patent Application Laid-Open Publication No. 2005-264732, a starter device is also proposed in which data on a rotation cycle corresponding to a rotational speed (cranking speed) at the start of an engine is stored as a fixed value, and an initial ignition position at the start is calculated using the data.

SUMMARY OF THE INVENTION

If the rotational speed at the start of the engine is always constant, the initial ignition position at the start can be properly determined even if data on a rotation cycle corresponding to a rotational speed (cranking speed) at the start of an engine is used as a fixed value as in the invention described in Japanese Patent Application Laid-Open Publication No. 2005-264732.

However, actually, the cranking speed of the engine is not always constant, and in the starter device disclosed in Japanese Patent Application Laid-Open Publication No. 2005-264732, the position for initial ignition after the commencement of the start operation sometimes cannot be properly determined, which may reduce startability of the engine. Particularly, in use of a recoil starter as a starter device, the rotational speed of the crankshaft greatly varies according to the degree of driver's force for pulling a rope of the starter. The cranking speed of the engine is significantly influenced by viscosity of a lubricant of the engine, and thus greatly varies according to ambient temperature at the start of the engine.

Thus, with the starter device disclosed in Japanese Patent Application Laid-Open Publication No. 2005-264732, a crank angle position for the initial ignition after the commencement of the start operation is often significantly displaced from a proper range, which inevitably reduces startability of the engine.

The present invention has an object to provide an ignition device for an internal combustion engine that can precisely determine an ignition position at the start of the engine to improve startability of the engine.

The present invention is directed to an ignition device for an internal combustion engine including: an exciter coil that is provided in an AC generator that rotates in synchronism with the internal combustion engine, and generates an AC voltage once for one rotation of a crankshaft of the internal combustion engine, the AC voltage having a half wave of a positive voltage and a half wave of first and second negative voltages generated before and after the half wave of the positive voltage; an ignition capacitor provided on a primary side of an ignition coil and charged to one polarity by the positive voltage; a discharge switch that conducts when receiving an ignition signal and discharges charges accumulated in the ignition capacitor through a primary coil of the ignition coil; a power supply circuit that charges a power supply capacitor with the first and second negative voltages of the exciter coil to generate a control DC voltage; and an ignition control portion that controls an ignition position of the internal combustion engine using a microprocessor that operates using the DC voltage output by the power supply circuit as a power supply voltage.

In the present invention, the ignition control portion includes: counting operation start means for causing a timer to start a counting operation when an output of the power supply circuit is established and the microprocessor starts operation; negative voltage determination means for determining whether a negative voltage output by the exciter coil is a first negative voltage or a second negative voltage when the negative voltage is detected; and start time ignition control means for arithmetically operating time required for the internal combustion engine to rotate from a crank angle position where the second negative voltage is detected to an ignition position suitable at the start at a rotational speed calculated from time $T_1$ between detection of the first negative voltage and detection of the second negative voltage by the negative voltage determination means when the internal combustion engine is at the start, as ignition position detecting counting data, when the second negative voltage is detected, and controlling a generation position of the ignition signal so that the ignition position of the internal combustion engine is set in a crank angle position suitable at the start by immediately starting measurement of the arithmetically operated ignition position detecting counting data.

The start time ignition control means is comprised so as to determine, when a negative voltage is initially detected after the commencement of a start operation of the internal combustion engine, whether the initially detected negative voltage is the first negative voltage or the second negative voltage, and when determining that the negative voltage is the second negative voltage, arithmetically operate the ignition position detecting counting data regarding a measurement value (time between the start of the operation of the microprocessor and initial detection of the second negative voltage) Ts of the timer as the time $T_1$ between detection of the first negative voltage and detection of the second negative voltage.

As described above, when the internal combustion engine is at the start, the time $T_1$ between detection of the first negative voltage and detection of the second negative voltage is measured, information on the rotational speed of the engine obtained from the time is used to calculate the counting data for detecting the ignition position at the start of the engine, and the measurement of the counting data is immediately started to generate the ignition signal at the start. Then, at the start of the engine when the rotational speed of the crankshaft of the engine minutely varies, the ignition position can be detected based on rotation information calculated immediately before the ignition position. Thus, the ignition position at the start can be precisely detected to improve startability of the engine.

When the start time ignition control means is comprised as described above, the ignition position at the start of the engine can be set in a position delayed from the generation position of the second negative voltage (a position beyond a section where the exciter coil generates the AC voltage), and thus a wide advance width of the ignition position can be obtained.

Particularly, as described above, the start time ignition control means is comprised so as to determine whether the negative voltage initially detected after the commencement of the start operation of the internal combustion engine is the first negative voltage or the second negative voltage, and when determining that the initially detected negative voltage is the second negative voltage, arithmetically operate the ignition position detecting counting data regarding the time $T_s$ between the start of the operation of the microprocessor and initial detection of the second negative voltage as the time $T_1$ between detection of the first negative voltage and detection of the second negative voltage. Thus, when the negative voltage initially detected after the commencement of the start operation is the second negative voltage, an ignition position can be detected with respect to a rotational speed substantially equal to an actual rotational speed of the engine for ignition operation immediately after the commencement of the start operation. Therefore, the probability that ignition can be performed at a proper crank angle position from the first rotation of the crankshaft can be increased to improve startability of the engine.

In a preferred aspect of the present invention, the ignition control portion is comprised of the following components:

(a) counting operation start means for causing a timer to start a counting operation when an output of the power supply circuit is established and the microprocessor starts operation;

(b) ignition signal generation means including an ignition timer that measures ignition position detecting counting data for generating an ignition signal when the ignition timer completes the measurement of the ignition position detecting counting data;

(c) negative voltage determination means for determining whether a negative voltage output by the exciter coil is a first negative voltage or a second negative voltage when the negative voltage is detected;

(d) start completion determination means for determining whether the internal combustion engine is at the start or has completed the start;

(e) start time ignition control means for arithmetically operating time required for the internal combustion engine to rotate from a detection position of the second negative voltage to an ignition position suitable at the start at a rotational speed of the internal combustion engine calculated from time between detection of the first negative voltage and detection of the second negative voltage and an angle between the detection position of the first negative voltage and the detection position of the second negative voltage when the start completion determination means determines that the internal combustion engine is at the start, as ignition position detecting counting data, when it is determined that the negative voltage detected by the negative voltage determination means is the second negative voltage, and controlling the ignition position of the internal combustion engine to the position suitable at the start by causing the ignition timer to immediately start measurement of the arithmetically operated ignition position detecting counting data;

(f) idle time advance control condition determination means for determining whether an idle time advance control condition is met that is a condition for permitting idle time advance control to advance an ignition position during idling immediately after completion of the start of the internal combustion engine from an ignition position during idling in normal operation in order to stabilize idling immediately after completion of the start of the internal combustion engine;

(g) idle time advance control means for controlling the generation position of the ignition signal so that when the idle time advance control condition determination means determines that the idle time advance control condition is met, the ignition position during idling immediately after completion of the start of the internal combustion engine is advanced from the ignition position during idling in normal operation; and (h) normal operation time ignition control means for controlling the generation position of the ignition signal so that when the start completion determination means determines that the internal combustion engine has completed the start, and the idle time advance control condition determination means determines that the idle time advance control condition is not met, the ignition position is set in a position suitable in normal operation of the internal combustion engine.

The start time ignition control means is comprised so as to arithmetically operate, when the negative voltage determination means determines that the negative voltage initially detected after the commencement of the start operation of the internal combustion engine is the second negative voltage, the ignition position detecting counting data regarding a measurement value of the timer in initial detection of the negative voltage as time between detection of the first negative voltage and detection of the second negative voltage.

The start completion determination means may be comprised so as to determine that the internal combustion engine is at the start when the rotational speed of the internal combustion engine is lower than a start determination speed, and determine that the internal combustion engine has completed the start when the rotational speed of the internal combustion engine is equal to or higher than the start determination speed continuously for a certain period. The start determination speed is set to be equal to the rotational speed at the time when the internal combustion engine has completed the start.

The start completion determination means may be also comprised so as to determine that the internal combustion engine is at the start when the rotational speed of the internal combustion engine is lower than the start determination speed, and the number of rotations of the crankshaft of the engine after the commencement of the start operation of the internal combustion engine is equal to or smaller than a set number, and determine that the internal combustion engine has completed the start when the rotational speed of the internal combustion engine is equal to or higher than the start determination speed continuously for a certain period, and when the number of rotations of the crankshaft of the engine after the commencement of the start operation of the internal combustion engine exceeds the set number though the rotational speed of the internal combustion engine is lower than the start determination speed. In this case, the set number is set to a value corresponding to the maximum number of rotations of the crankshaft when cranking is manually performed in a state where the internal combustion engine cannot be started (for example, in a state where the ignition operation of the ignition device is stopped).

When the start completion determination means is comprised as described above, the number of rotations of the crankshaft after the commencement of the start operation of the internal combustion engine does not exceed the set number in the case where the engine is started by a manual starter device such as a recoil starter, and thus it is determined that the engine is at the start when the rotational speed of the engine is lower than the start determination speed, and it is determined that the start has been completed when the rotational speed of the engine is equal to or higher than the start determination speed continuously for a certain period (in normal operation). Thus, in the case where the engine is manually started, the ignition position at the start can be set in a position suitable at the start near the top dead center position, thereby improving startability of the engine.

On the other hand, in the case where the engine is started by cranking using a starter motor, the rotation of the engine is maintained by the starter motor even without voluntary rotation of the engine. In this case, if only one ignition position (start time ignition position) suitable at the start is set in a position near the top dead center position, ignition is performed in the set start time ignition position when it is determined that the rotational speed is lower than the set rotational speed at the start, and ignition is shifted to normal ignition when the rotational speed reaches the set rotational speed, pulsing of cranking may be more likely to cause a kickback (a phenomenon in which a piston cannot exceed the top dead center and is pushed back).

In order to prevent such a problem, it is preferable that a plurality of start time ignition positions are previously set, and an optimum ignition position is selected from the plurality of ignition positions set as the start time ignition positions according to the rotational speed arithmetically operated from a cycle of detection of the first negative voltage.

For example, it is preferable that two start time ignition positions: a first start time ignition position near the top dead center position, and a second start time ignition position advanced from the first start time ignition position (an ignition position suitable as an ignition position during idling) are set as the ignition positions suitable at the start, an ignition position switching rotational speed IGCHNE for switching the start time ignition position, and a start determination speed SNCHNE for determining whether the engine is in operation at the start are set, ignition is performed in the first start time ignition position near the top dead center position when IGCHNE<rotational speed, and the ignition operation is performed in the second start time ignition position when IGCHNE≦rotational speed<SNCHNE.

Comprised as described above, for example, the ignition position at the commencement of the start can be made different from an ignition position after initial explosion, and the ignition position at the commencement of the start and the ignition position after initial explosion can be set in optimum positions. This can improve startability of the engine, and stabilize rotation of the engine in a process of shifting to idling after the start of the engine.

In a preferred aspect of the present invention, the idle time advance control condition determination means is comprised so as to determine that the idle time advance control condition is met when the number of ignitions by the idle time advance control means is equal to or smaller than a set value, and determine that the idle time advance control condition is not met when the number of ignitions by the idle time advance control means exceeds the set value.

In another preferred aspect of the present invention, the idle time advance control condition determination means is comprised so as to determine that the idle time advance control condition is met when an elapsed time from the start of control of the ignition position by the idle time advance control means is equal to or shorter than a set time, and determine that the idle time advance control condition is not met when the elapsed time from the start of control of the ignition position by the idle time advance control means exceeds the set time.

In a further preferred aspect of the present invention, the idle time advance control condition determination means is comprised so as to determine that the idle time advance control condition is met when a period in which the rotational speed of the internal combustion engine is continuously equal to or higher than an idle time advance control determination speed does not reach a set certain period, and determine that the idle time advance control condition is no longer met when the period in which the rotational speed of the internal combustion engine is continuously equal to or higher than the idle time advance control determination speed reaches the set certain period.

In a further preferred aspect of the present invention, the idle time advance control condition determination means is comprised so as to determine that the idle time advance control condition is met when a period in which the rotational speed of the internal combustion engine is continuously equal to or higher than a set idle time advance control determination speed does not reach a set certain period, and when the number of ignitions by the idle time advance control means is equal to or smaller than a set value, and determine that the idle time advance control condition is no longer met when the period in which the rotational speed of the internal combustion engine is continuously equal to or higher than the idle time advance control determination speed reaches the certain period, and when the number of ignitions by the idle time advance control means reaches the set value though the period in which the rotational speed of the internal combustion engine is continuously equal to or higher than the idle time advance control determination speed does not reach the certain period.

In a preferred aspect of the present invention, the idle time advance control means is comprised so as to arithmetically operate time required for the internal combustion engine to rotate, at an idling speed of the internal combustion engine calculated from a cycle of detection of the first negative voltage, from the detection position of the first negative voltage to an ignition position in idle time advance control set in a position advanced from the ignition position at the idling speed in normal operation of the internal combustion engine, as the ignition position detecting counting data, in the generation position of the second negative voltage, and control the ignition position of the internal combustion engine to be advanced from the ignition position during idling in normal operation by causing the ignition timer to immediately start measurement of the arithmetically operated ignition position detecting counting data.

In another preferred aspect of the present invention, the idle time advance control means is comprised so as to arithmetically operate time required for the internal combustion engine to rotate, at a rotational speed of the internal combustion engine calculated from time between detection of the first negative voltage and detection of the second negative voltage and an angle between the detection position of the first negative voltage and the detection position of the second negative voltage, from the detection position of the second negative voltage to an ignition position in idle time advance control set in a position advanced from the ignition position at the idling speed in normal operation of the internal combustion engine, as ignition position detecting counting data in idle time advance control, in the detection position of the second negative voltage, and control the ignition position of the internal combustion engine to be advanced from the ignition position during idling in normal operation by causing the ignition timer to immediately start measurement of the arithmetically operated ignition position detecting counting data.

As described above, the idle time advance control means is provided for controlling the generation position of the ignition signal so as to advance the ignition position of the internal combustion engine from the ignition position during idling in normal operation when the start completion determination means determines that the internal combustion engine has completed the start, and the idle time advance control condition determination means determines that the condition for performing the idle time advance control is met. This can prevent a reduction in rotational speed of the engine during idling immediately after completion of the start and maintain rotation of the engine, thereby allowing idling immediately after the start of the engine to be stabilized in a short time even in cold climates or the like where the rotation of the engine becomes unstable.

In the present invention, the idle time advance control is performed only when the predetermined idle time advance control condition (the condition for permitting control to advance the ignition position from the ignition position during idling in normal operation in order to stabilize idling immediately after the start) is met, thereby allowing the idling immediately after the start to be stabilized without an unnecessary increase or the like in idling speed immediately after the start.

Particularly, in the present invention, in the case where the idle time advance control is performed only until the period in which the rotational speed of the internal combustion engine is continuously equal to or higher than the idle time advance control determination speed reaches the set certain period, or the case where the idle time advance control is performed when the period in which the rotational speed of the internal combustion engine is continuously equal to or higher than the set idle time advance control determination speed does not reach the set certain period and the number of ignitions by the idle time advance control means is equal to or smaller than the set value, the idle time advance control is performed to reliably prevent a rapid increase in the rotational speed of the engine, thereby allowing the idling immediately after the start to be stabilized without providing uncomfortable feeling to a driver.

An arithmetical operation of the ignition position detecting counting data in normal operation may be performed in the generation position of the second negative voltage, but for precise measurement of the arithmetically operated ignition position in normal operation, it is preferable to arithmetically operate counting data for detecting the ignition position of the engine from the rotational speed calculated immediately before the ignition position where the measurement of the ignition position is started. Thus, timing for performing the arithmetical operation of the ignition position detecting counting data in normal operation and a processing for causing the ignition timer to start the measurement of the counting data is preferably timing for the generation of the first negative voltage.

Thus, in a preferred aspect of the present invention, the normal operation time ignition control means is comprised so as to perform a process of arithmetically operating an ignition position in normal operation of the internal combustion engine arithmetically operated with respect to the rotational speed of the internal combustion engine calculated from a generation cycle of the first negative voltage, and time required for the engine to rotate from the generation position of the first negative voltage to the arithmetically operated ignition position in normal operation at the rotational speed of the internal combustion engine calculated from the generation cycle of the first negative voltage, as ignition position detecting counting data in normal operation, and a process of causing the ignition timer to start the measurement of the ignition position detecting counting data in normal operation, when the first negative voltage is detected.

As described above, when the processing for measuring the ignition position in normal time is performed in the generation position of the first negative voltage before the generation position of the second negative voltage for performing the processing for measuring the ignition position at the start of the engine (the generation position of the first negative voltage is set as a reference crank angle position for determining the ignition position in normal operation), a wide advance width of the ignition position can be obtained, and also the arithmetically operated ignition position can be precisely detected to control the ignition position with high accuracy.

In a further preferred aspect of the present invention, the start time ignition control means includes ignition permission and prevention means for unconditionally permitting generation of the ignition signal when the internal combustion engine is in an initial state at the start, permitting generation of the ignition signal at the start when the internal combustion engine is no longer in the initial state at the start, and a ratio $T_0/T_1$ between time $T_0$ between detection of the second negative voltage and detection of the next first negative voltage and time $T_1$ between detection of the first negative voltage and detection of the second negative voltage is equal to or larger than a set value, and preventing the generation of the ignition signal at the start when the internal combustion engine is no longer in the initial state at the start, and the ratio $T_0/T_1$ is smaller than the set value.

The ignition permission and prevention means may be comprised so as to unconditionally permit generation of the ignition signal when the internal combustion engine is in the initial state at the start, permit generation of the ignition signal at the start when the internal combustion engine is no longer in the initial state at the start, and the time $T_1$ between detection of the first negative voltage and detection of the second negative voltage is equal to or shorter than a set value, and prevent the generation of the ignition signal at the start when the internal combustion engine is no longer in the initial state at the start, and the time $T_1$ exceeds the set value.

The start time ignition control means includes the above described ignition permission and prevention means, and thus the ignition operation can be prevented when a cranking speed is insufficient because of an insufficient operation force after the commencement of the start operation, thereby preventing a phenomenon (kickback) in which a piston cannot exceed the top dead center and is pushed back when the engine is manually started using a recoil starter or a kick starter.

The negative voltage determination means used in a preferred aspect of the present invention includes means for setting a positive voltage detection flag when the positive voltage is detected, and clearing the positive voltage detection flag after the generation of the negative voltage, and is comprised so as to determine that the negative voltage detected without the flag being set is the first negative voltage, and that the negative voltage detected with the flag being set is the second negative voltage.

The negative voltage determination means used in another preferred aspect of the present invention is comprised of start time initial determination means for determining whether the internal combustion engine is in the initial state at the start, first determination means for determining whether the negative voltage is the first negative voltage or the second negative voltage when the start time initial determination means determines that the internal combustion engine is in the initial state at the start, and second determination means for determining whether the negative voltage is the first negative voltage or the second negative voltage when the start time initial determination means determines that the internal combustion engine is no longer in the initial state at the start.

In this case, the first determination means includes means for setting a positive voltage detection flag when the positive voltage is detected and clearing the positive voltage detection flag after the negative voltage is detected, and is comprised so as to determine that the negative voltage detected without the flag being set is the first negative voltage, and that the negative voltage detected with the flag being set is the second negative voltage.

The second determination means is comprised so as to compare an elapsed time $T_{old}$ measured last time by elapsed time measurement means with an elapsed time $T_{new}$ detected this time, the elapsed time measurement means reading a measurement value of a timer that measures an elapsed time for each detection of each negative voltage and measuring an elapsed time between detection of the last negative voltage and detection of this negative voltage, determine that the negative voltage detected this time is the first negative voltage when the relationship of $T_{new}<T_{old}/k$ (k is a constant equal to or larger than one) is not met, and determine that the negative voltage detected this time is the second negative voltage when the relationship of $T_{new}<T_{old}/k$ is met.

The value of the constant k is set to be larger than one, and smaller than the value of an angle between the generation position of the second negative voltage generated in forward rotation of the internal combustion engine and the next generation position of the first negative voltage, divided by an angle between the generation position of the first negative voltage and the generation position of the second negative voltage. The value of the constant k is set to an appropriate value, thereby eliminating the risk of accidentally detecting the generation position of the first negative voltage and the generation position of the second negative voltage in sudden acceleration or sudden deceleration of the engine.

In a preferred aspect of the present invention, the start time initial determination means is comprised so as to determine that the internal combustion engine is in the initial state at the start when the number of ignition operations performed after the commencement of the start operation of the internal combustion engine is smaller than a set value, and determines that the internal combustion engine is no longer in the initial state at the start when the number of ignition operations performed after the commencement of the start operation of the internal combustion engine is equal to or larger than the set value.

In a preferred aspect of the present invention, the start time initial determination means is comprised so as to determine that the internal combustion engine is in the initial state at the start when the rotational speed of the internal combustion engine calculated from time between detection of the first negative voltage and detection of the second negative voltage is lower than a set value, and determines that the internal combustion engine is no longer in the initial state at the start when the rotational speed of the internal combustion engine calculated from time between detection of the first negative voltage and detection of the second negative voltage is equal to or higher than the set value.

In a preferred aspect of the present invention, a capacitance and a charging time constant of the power supply capacitor of the power supply circuit are set so that an output voltage of the power supply circuit reaches a level required for operating the microprocessor until the negative voltage initially induced in the exciter coil at the start of the internal combustion engine reaches its peak.

If the power supply circuit is comprised as described above, when the exciter coil initially generates a negative voltage after the commencement of the start operation, the microprocessor starts operation to start a counting operation of the timer until the negative voltage reaches its peak. Thus, there is a slight difference between the time $T_s$ between the start of the operation of the microprocessor after the exciter coil generates the first negative voltage and the initial generation of the second negative voltage and the time $T_1$ between generation of the first negative voltage and generation of the second negative voltage. Thus, comprised as described above, when the initially generated negative voltage is the first negative voltage, the rotational speed immediately after the commencement of the start operation can be substantially precisely detected to precisely detect a crank angle position for initial ignition at the start.

Herein, positive and negative polarities of half wave voltages of the AC voltage output by the exciter coil do not mean polarities in a waveform chart (absolute polarities), but among half wave voltages of one and the other polarities of the AC voltage output by the exciter coil, a half wave voltage having a polarity used for charging an ignition capacitor of an ignition circuit is a positive voltage, and a half wave voltage having a polarity opposite to the polarity used for charging the ignition capacitor is a negative voltage.

As described above, according to the present invention, the start time ignition control means is comprised so as to determine, when the negative voltage is initially generated after the commencement of the start operation of the internal combustion engine, whether the initially detected negative voltage is the first negative voltage or the second negative voltage, and when determining that the initially generated negative voltage is the second negative voltage, arithmetically operate the ignition position detecting counting data regarding the time $T_s$ between the start of the operation of the microprocessor and the initial generation of the second negative voltage as the time $T_1$ between generation of the first negative voltage and generation of the second negative voltage. Thus, when the negative voltage initially generated after the commencement of the start operation is the first negative voltage, an ignition position can be detected according to a rotational speed substantially equal to an actual rotational speed of the engine for ignition operation immediately after the commencement of the start operation. Therefore, according to the present invention, the probability that ignition can be performed at a proper crank angle position from the first rotation of the crankshaft can be increased to improve startability of the engine.

DESCRIPTION OF SYMBOLS

Figure 1:
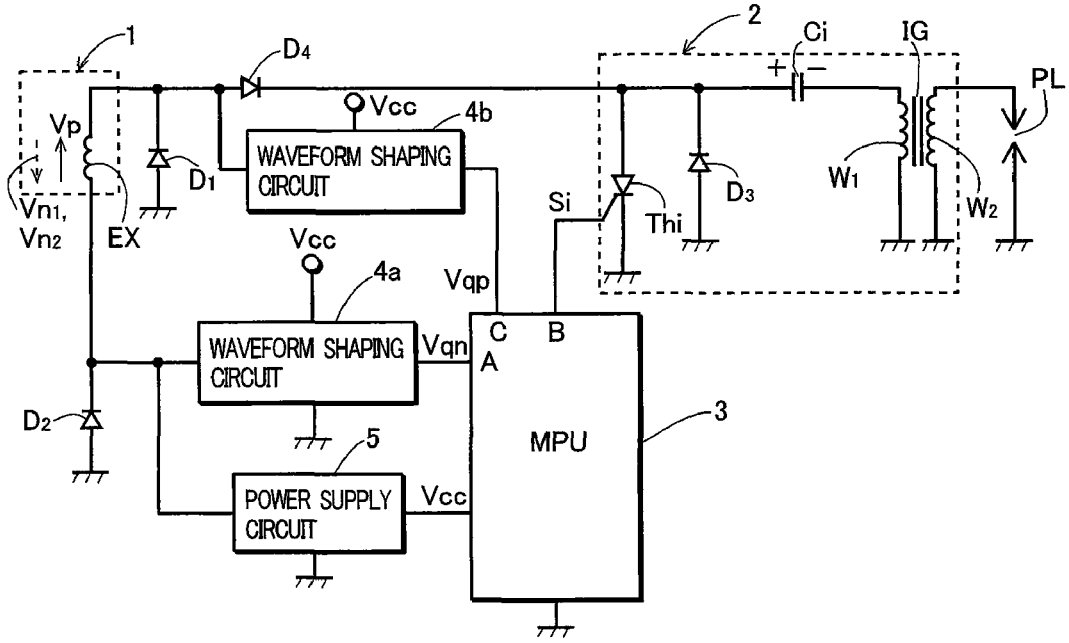
FIG. 1 is a schematic circuit diagram of an exemplary construction of hardware of an ignition device according to the present invention.

1 magnet type AC generator
2 ignition circuit
3 microprocessor
4*a* first waveform shaping circuit
4*b* second waveform shaping circuit
20 ignition control portion
21 ignition signal generation means
22 elapsed time measurement means
23 negative voltage determination means
24 start completion determination means
25 rotational speed arithmetical operation means
26 start time ignition control means
27 idle time advance control condition determination means
28 idle time advance control means
29 normal operation time ignition control means
30 start time ignition position detecting counting data arithmetical operation means
31 ignition permission and prevention means
32 ignition timer control means
33 idle time advance control time ignition position arithmetical operation means
34 ignition position detecting counting data arithmetical operation means
35 ignition timer control means
36 normal time ignition position detecting counting data arithmetical operation means
37 ignition timer control means
38 counting operation start means

BEST MODE FOR CARRYING OUT THE INVENTION

Now, preferred embodiments of the present invention will be described with reference to the drawings.

FIG. 1 schematically shows a construction of hardware of the embodiment. In FIG. 1, a reference numeral 1 denotes a magneto generator driven by an unshown internal combustion engine, 2 denotes a capacitor discharge ignition circuit, 3 denotes a microprocessor, 4*a* and 4*b* denote first and second waveform shaping circuits, 5 denotes a power supply circuit that supplies a power supply voltage Vcc to the microprocessor 3 and the waveform shaping circuits 4.

Figure 2A:
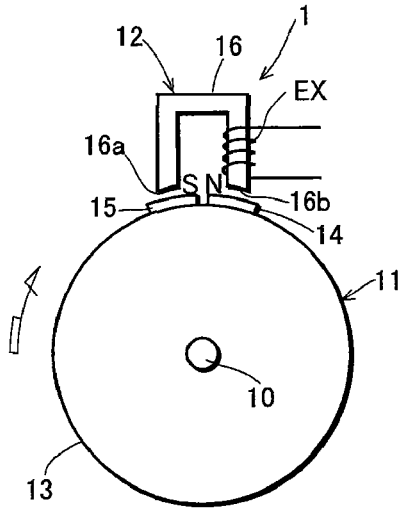
FIGS. 2(A) and 2(B) are schematic block diagrams of different exemplary constructions of magnet type AC generators that can be used in the present invention.

As shown in FIG. 2A, the magnet type AC generator 1 used in the embodiment is comprised of a magnet rotor 11 mounted to a crankshaft 10 of an internal combustion engine (not shown), and a stator 12. The magnet rotor 11 is comprised of an aluminum flywheel 13 mounted to the crankshaft 10, permanent magnets 14 and 15 magnetized radially of the flywheel and molded in the flywheel 13 with a north pole and a south pole exposed to the outside, and an unshown magnetic path forming member molded in the flywheel 13 together with the permanent magnets 14 and 15 and connecting between the south pole of the permanent magnet 14 and the north pole of the permanent magnet 15. The stator 12 is comprised of a Π-shaped armature core 16 having, at opposite ends, magnetic pole portions 16*a* and 16*b* that face the magnetic poles of the magnets 14 and 15, and an exciter coil EX wound around the armature core 16, and secured to a stator mounting portion provided in a case or a cover of the internal combustion engine.

As shown in FIG. 4A, the exciter coil EX generates an AC voltage once for one rotation of a crankshaft of the engine in forward rotation of the internal combustion engine, the AC voltage having a half wave of a positive voltage $V_p$, and a half wave of first and second negative voltages $V_{n1}$ and $V_{n2}$ generated before and after the half wave of the positive voltage $V_p$. In the embodiment, a mounting position of the stator 12 is set so that the second negative voltage $V_{n2}$ is generated in a position sufficiently advanced from a top dead center position (a crank angle position when a piston of the engine reaches a top dead center) TDC of the engine.

One end of the exciter coil EX is connected to a cathode of a diode $D_1$ having a grounded anode, and the other end of the exciter coil is similarly connected to a cathode of a diode $D_2$ having a grounded anode. The ignition circuit 2 in FIG. 1 is comprised of an ignition coil IG in which one ends of a primary coil $W_1$ and a secondary coil $W_2$ are grounded, an ignition capacitor $C_i$ having one end connected to a non-ground terminal of the primary coil of the ignition coil IG, a thyristor $T_{hi}$ as a discharge switch connected between the other end of the ignition capacitor $C_i$ and the ground with a cathode directed to the ground, and a diode $D_3$ connected in anti-parallel with opposite ends of the thyristor $T_{hi}$ for extending a discharge time of ignition spark. When one end of the exciter coil EX is connected to the other end of the ignition capacitor $C_i$ through a diode $D_4$ having an anode directed to the exciter coil, and the exciter coil outputs a positive voltage, a current passes through a capacitor charging circuit comprised of a circuit of the exciter coil EX—the diode $D_4$—the ignition capacitor $C_i$—the primary coil $W_1$ of the ignition coil—the diode $D_2$—the exciter coil EX, and the ignition capacitor $C_i$ is charged to the shown polarity.

A gate of the thyristor $T_{hi}$ that constitutes the discharge switch is connected to a port B of the microprocessor 3. As described later, the microprocessor 3 obtains rotation information of the internal combustion engine from a negative voltage of the exciter coil EX to determine an ignition position (a crank angle position where an ignition operation is performed) of the internal combustion engine, and provides an ignition signal $S_i$ from the port B to the gate of the thyristor $T_{hi}$ when the determined ignition position is detected. When the ignition signal $S_i$ is provided to the thyristor $T_{hi}$, the thyristor $T_{hi}$ conducts and discharges charges accumulated in the ignition capacitor $C_i$ through the primary coil $W_1$ of the ignition coil. Thus, a high voltage is induced in the primary coil of the ignition coil IG, this voltage is further increased by a ratio of voltage increase between the primary and secondary coils of the ignition coil, and a high voltage for ignition is induced in the secondary coil $W_2$ of the ignition coil. This high voltage is applied to an ignition plug PL mounted to a cylinder of the internal combustion engine, and thus spark discharge occurs in the ignition plug to ignite the engine.

In the embodiment, the internal combustion engine is a single cylinder engine for simplicity of description. In the case of a multi-cylinder engine, for example, ignition circuits 2 of the number of cylinders are provided, stators including an exciter coil EX of the number of cylinders are provided, and an ignition capacitor of an ignition circuit for each cylinder is charged by a positive voltage output by an exciter coil for each cylinder, and rotation information for each cylinder is provided from the exciter coil for each cylinder to the microprocessor 3 to provide an ignition signal from the microprocessor 3 to a thyristor of the ignition circuit for each cylinder in an ignition position of each cylinder. In the case of a two-cylinder internal combustion engine, a double ended ignition coil may be comprised so that one end and the other end of a secondary coil $W_2$ of an ignition coil IG are connected to non-ground terminals of ignition plugs of different cylinders, and spark discharge is simultaneously caused in the ignition plugs of the two cylinders of the engine.

The power supply circuit 5 is comprised of a circuit that charges a power supply capacitor with the negative voltage output by the exciter coil EX, and a regulator that controls a voltage across the power supply capacitor at a constant value, and outputs a power supply voltage Vcc to the microprocessor 3 and the waveform shaping circuits 4*a* and 4*b*. In the present invention, a capacitance and a charging time constant of the power supply capacitor of the power supply circuit are set so that an output voltage of the power supply circuit 5 reaches a certain value required for operating the microprocessor 3 until the negative voltage initially induced in the exciter coil at the start of the internal combustion engine reaches its peak. Thus, as shown in FIG. 4(B), the power supply voltage Vcc has a waveform that reaches a certain voltage until the negative voltage (the first negative voltage $V_{n1}$ in the shown example) initially output by the exciter coil 3 and then maintains a substantially fixed value.

The first waveform shaping circuit 4*a* in FIG. 1 is a circuit that converts the negative voltages $V_{n1}$ and $V_{n2}$ output by the exciter coil EX to a signal recognizable by the microprocessor 3. As shown in FIG. 4(C), the waveform shaping circuit 4*a* in the embodiment shapes a waveform of a negative half wave voltage generated by the exciter coil EX and maintains a low level (L level) while the negative voltages $V_{n1}$ and $V_{n2}$ are generated, and generates a first rectangular wave signal $V_{qn}$ that maintains a high level (H level) when the negative voltages $V_{n1}$ and $V_{n2}$ are not generated. The rectangular wave signal $V_{qn}$ is input in a port A of the microprocessor 3. The microprocessor 3 recognizes a trailing edge of the rectangular wave signal $V_{qn}$ as a crank signal. The rectangular wave signal $V_{qn}$ can be obtained, for example, across switch means that maintains an ON state only while the negative voltages $V_{n1}$ and $V_{n2}$ are generated.

The first rectangular wave signal $V_{qn}$ has a trailing edge in the generation position of the first negative voltage $V_{n1}$ and the generation position of the second negative voltage $V_{n2}$ output by the exciter coil, and a leading edge in a position where the first negative voltage $V_{n1}$ and the second negative voltage disappear. In the embodiment, the trailing edge of the first rectangular wave signal $V_{qn}$ that appears twice during one rotation of the crankshaft of the engine is recognized as a crank signal by the microprocessor to obtain rotation information of the engine. The generation position of the first negative voltage $V_{n1}$ (the generation position of the first crank signal) and the generation position of the second negative voltage $V_{n2}$ (the generation position of the second crank signal) are denoted by reference characters $CR_{in}$ and $CR_{out}$ to identify the generation positions of the two negative voltages (the generation positions of the crank signal).

In the embodiment, the generation position $CR_{in}$ of the first negative voltage $V_{n1}$ is used as a reference crank angle position for determining timing for capturing time data for calculating the rotational speed of the engine, and starting measurement of the ignition position in normal operation of the engine, and the generation position $CR_{out}$ of the second negative voltage $V_{n2}$ is used as a position for starting measurement of the ignition position at the start of the engine.

As shown in FIG. 4(D), the second waveform shaping circuit 4*b* outputs a second rectangular wave signal $V_{qp}$ having a trailing edge in a generation position of a positive voltage $V_p$ output by the exciter coil, and a leading edge in a position where the positive voltage $V_p$ disappears. The second rectangular wave signal $V_{qp}$ is input in a port C of the microprocessor 3. In the embodiment, the microprocessor recognizes the trailing edge of the rectangular wave signal $V_{qp}$ to obtain information on the exciter coil having output the positive voltage $V_p$.

Figure 20:
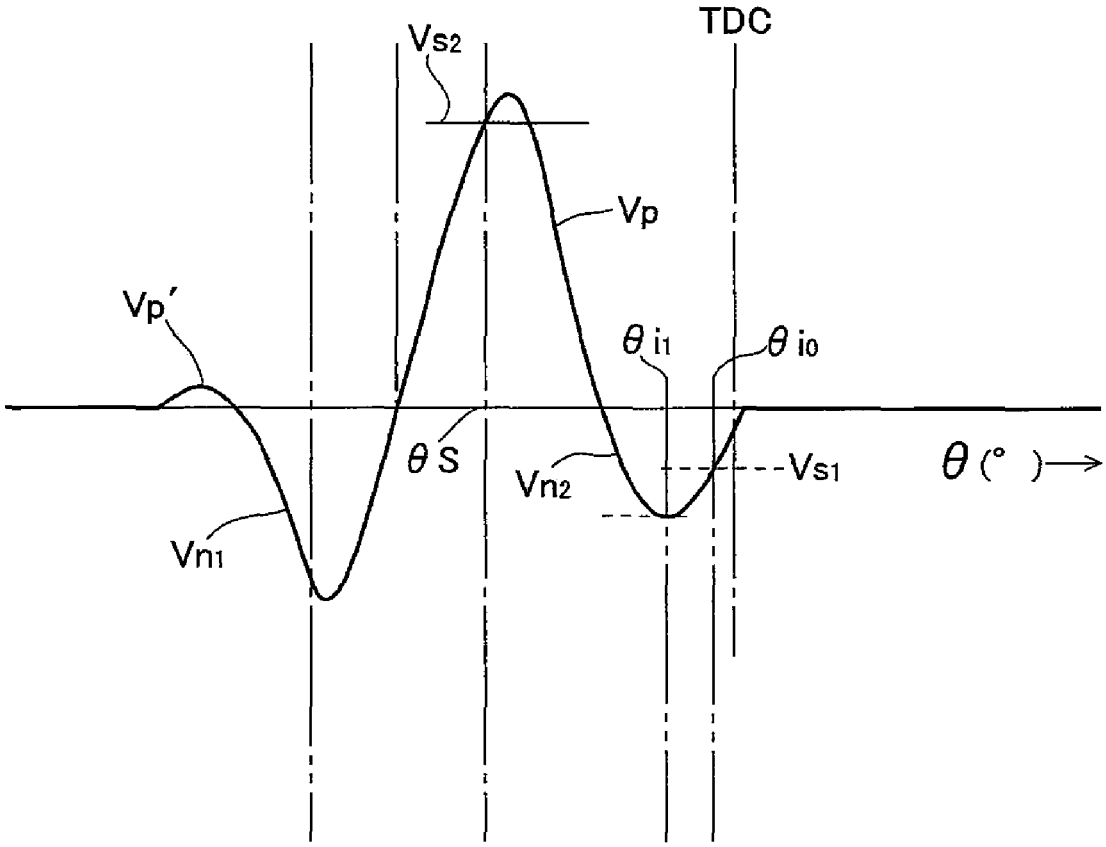
FIG. 20 is a waveform chart showing a waveform of an output voltage of an exciter coil used for illustrating an operation of a conventional ignition device.

Depending on the construction of the magneto generator, the exciter coil EX outputs a positive voltage $V_{p'}$ with a low peak value before outputting the first negative voltage $V_{n1}$ as shown in FIG. 20, but detection of the positive voltage $V_{p'}$ can be prevented by setting a threshold of the waveform shaping circuit 46 to a high value.

Figure 3:
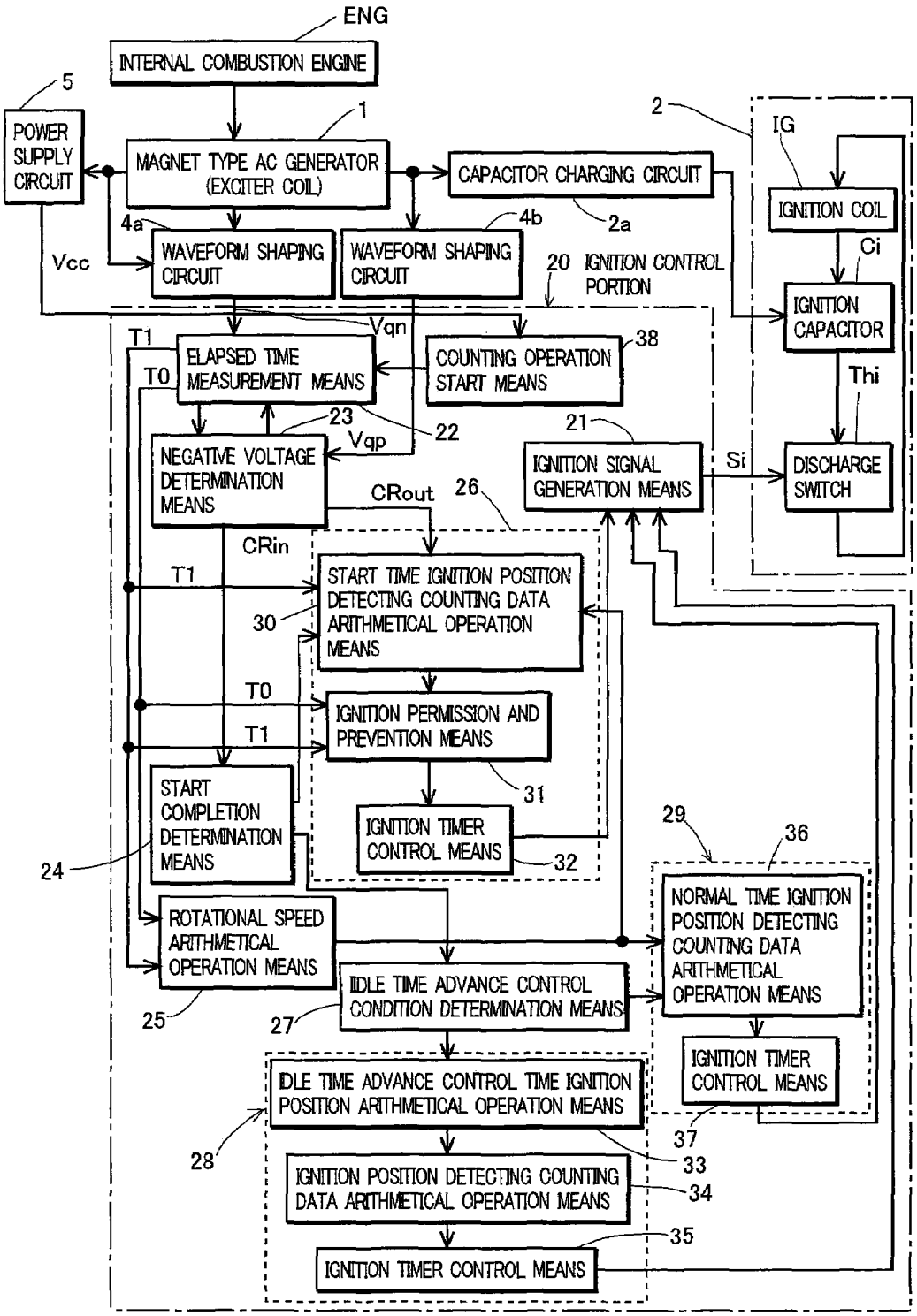
FIG. 3 is a block diagram of an entire construction including a construction of an ignition control portion in a first embodiment of the present invention.

The microprocessor 3 performs a predetermined program to comprise various function achieving means, and comprise an ignition control portion that provides an ignition signal to the discharge switch in the ignition position of the internal combustion engine. FIG. 3 is a block diagram of an exemplary construction of the ignition control portion. In FIG. 3, a reference numeral 1 denotes the magnet type AC generator comprised as shown in FIG. 2(A) and driven by an internal combustion engine ENG, 2 denotes the ignition circuit including the ignition coil IG, the ignition capacitor $C_i$, and the discharge switch $T_{hi}$ comprised of the thyristor, and 2*a* denotes a capacitor charging circuit that charges the ignition capacitor $C_i$ with a positive voltage of the exciter coil provided in the magnet type AC generator.

A reference numeral 20 denotes the ignition control portion, and the ignition control portion is comprised of ignition signal generation means 21, elapsed time measurement means 22, negative voltage determination means 23, start completion determination means 24, rotational speed arithmetical operation means 25, start time ignition control means 26, idle time advance control condition determination means 27, idle time advance control means 28, normal operation time ignition control means 29, and counting operation start means 38.

In more detail, the ignition signal generation means 21 includes an ignition timer that measures ignition position detecting counting data, and generates an ignition signal $S_i$ when the ignition timer completes measurement of the ignition position detecting counting data.

The counting operation start means 38 provides a counting operation start command to the elapsed time measurement means 22 when the output voltage of the power supply circuit 5 reaches a voltage value required for operating the microprocessor 3.

The elapsed time measurement means 22 causes a timer provided in the microprocessor to start a counting operation when receiving the counting operation start command from the counting operation start means 38, then reads a measurement value of the timer for each detection of each trailing edge (crank signal) of the first rectangular wave signal $V_{qn}$, and detects an elapsed time between timing when the output voltage of the power supply circuit is established and the microprocessor 3 starts operation and detection of the negative voltage initially generated after the commencement of the start operation, and an elapsed time (a generation cycle of the crank signal) between detection of each trailing edge (crank signal) of the first rectangular wave signal $V_{qn}$ and detection of the next trailing edge.

The elapsed time measurement means 22 used in the embodiment reads a measurement value of the timer at the present time (when the negative voltage is initially generated after the commencement of the start operation) as an elapsed time $T_s$ between the start of the operation of the microprocessor and initial detection of the negative voltage after the commencement of the start operation of the engine when the trailing edge (crank signal) of the rectangular wave signal $V_{qn}$ output by the waveform shaping circuit 4 is initially detected after the commencement of the start operation of the internal combustion engine (when the negative voltage is initially detected after the commencement of the start operation).

The elapsed time measurement means 22 also subtract a measurement value of the timer read in detection of the last trailing edge of the rectangular wave signal $V_{qn}$ from a measurement value of the timer read in detection of this trailing edge of the rectangular wave signal $V_{qn}$ for each detection of the second trailing edge and thereafter of the rectangular wave signal $V_{qn}$ after the commencement of the start operation to measure time between detection of the last trailing edge ($CR_{in}$ or $CR_{out}$) of the rectangular wave signal $V_{qn}$ and detection of this trailing edge ($CR_{out}$ or $CR_{in}$). Among times measured by the elapsed time measurement means 22 for each detection of the second trailing edge and thereafter of the rectangular wave signal $V_{qn}$ after the commencement of the start operation, time between detection of the generation position ($CR_{in}$) of the first negative voltage $V_{n1}$ and detection of the generation position ($CR_{out}$) of the second negative voltage is $T_1$, and time between detection of the generation position ($CR_{out}$) of the second negative voltage $V_{n2}$ and detection of the generation position ($CR_{in}$) of the first negative voltage is $T_0$.

The negative voltage determination means 23 determines whether the negative voltage detected (input in the port A of the microprocessor) is the first negative voltage $V_{n1}$ or the second negative voltage $V_{n2}$. The negative voltage determination means 23 used in the embodiment is comprised of start time initial determination means for determining whether the internal combustion engine is in an initial state at the start, first determination means for determining whether the negative voltage is the first negative voltage or the second negative voltage when the start time initial determination means determines that the internal combustion engine is in the initial state at the start, and second determination means for determining whether the negative voltage is the first negative voltage or the second negative voltage when the start time initial determination means determines that the internal combustion engine is no longer in the initial state at the start.

The start time initial determination means is preferably comprised, for example, so as to determine that the internal combustion engine is in the initial state at the start when the number of ignition operations performed after the commencement of the start operation of the internal combustion engine is smaller than a set value, and determines that the internal combustion engine is no longer in the initial state when the number of ignition operations performed after the commencement of the start operation of the internal combustion engine is equal to or larger than the set value.

The start time initial determination means may be comprised so as to determine that the internal combustion engine is in the initial state at the start when the rotational speed of the internal combustion engine calculated from time between detection of the first negative voltage and detection of the second negative voltage is lower than a set value, and determines that the internal combustion engine is no longer in the initial state at the start when the rotational speed of the internal combustion engine calculated from time between detection of the first negative voltage and detection of the second negative voltage is equal to or higher than the set value.

The first determination means used in the embodiment includes means for setting a positive voltage detection flag when a positive voltage is detected and clearing the positive voltage detection flag after the negative voltage is generated, and is comprised so as to determine that a negative voltage detected without the positive voltage detection flag being set is the first negative voltage $V_{n1}$, and that a negative voltage detected with the positive voltage detection flag being set is the second negative voltage $V_{n2}$.

The second determination means determines whether the detected negative voltage is the first negative voltage $V_{n1}$ or the second negative voltage $V_{n2}$ from a difference in length between the time $T_1$ between detection of the generation position $CR_{in}$ of the first negative voltage $V_{n1}$ and detection of the generation position $CR_{out}$ of the second negative voltage $V_{n2}$ and the time T0 between detection of the generation position $CR_{out}$ of the second negative voltage and detection of the generation position $CR_{in}$ of the first negative voltage.

The second determination means used in the embodiment compares time $T_{old}$ detected last time by the elapsed time measurement means 22 with time $T_{new}$ detected this time (see FIG. 4), determine that the negative voltage detected this time is the first negative voltage (this trailing edge position of the rectangular wave signal is the generation position $CR_{in}$ of the first negative voltage $V_{n1}$) when the relationship of $T_{new}<T_{old}/k$ (k is a constant equal to or larger than one) is not met, and determine that the negative voltage detected this time is the second negative voltage (this trailing edge position of the rectangular wave signal is the generation position $CR_{out}$ of the second negative voltage $V_{n2}$) when the relationship of $T_{new}<T_{old}/k$ is met.

The elapsed time measurement means 22 recognizes that the elapsed time captured this time is $T_0$ when the negative voltage determination means 23 determines that the negative voltage detected this time is the first negative voltage $V_{n1}$, and recognizes that the elapsed time captured this time is $T_1$ when the negative voltage determination means 23 determines that the negative voltage detected this time is the second negative voltage $V_{n2}$.

The start completion determination means 24 determines whether the internal combustion engine is at the start or has completed the start. The shown start completion determination means 24 is comprised so as to detect the number of rotations Pulse_cnt of the crankshaft of the engine after the commencement of the start operation of the internal combustion engine from the number of detections of the generation position ($CR_{in}$) of the first negative voltage $V_{n1}$, determines that the internal combustion engine is at the start (the start has not been completed) when the number of rotations Pulse_cnt is equal to or smaller than a set value STARTNUM (when Pulse_cnt≦STARTNUM), and determines that the internal combustion engine has completed the start when the number of rotations Pulse_cnt of the crankshaft of the engine exceeds the set value STARTNUM (when STARTNUM<Pulse_cnt) after the commencement of the start operation of the internal combustion engine.

The rotational speed arithmetical operation means 25 arithmetically operates the rotational speed of the internal combustion engine from a cycle $T_2$ of detection of the generation position $CR_{in}$ of the first negative voltage $V_{n1}$. The shown rotational speed arithmetical operation means 25 adds the times $T_0$ and $T_1$ measured by the elapsed time measurement means 22 for each detection of the generation position $CR_{in}$ of the first negative voltage, calculates the elapsed time $T_2$ (the cycle of detection of the generation position $CR_{in}$ of the first negative voltage) between the last detection of the generation position $CR_{in}$ of the first negative voltage and this detection of the generation position $CR_{in}$ of the first negative voltage, and arithmetically operates the rotational speed of the engine from the elapsed time $T_2$.

The start time ignition control means 26 controls the generation position of the ignition signal when the start completion determination means 24 determines that the internal combustion engine is at the start. The start time ignition control means performs a process of arithmetically operating time $T_{igs}$ required for the internal combustion engine to rotate from the generation position of the second negative voltage $V_{n2}$ to an ignition position $\theta_{igs}$ suitable at the start (see FIG. 4) at the rotational speed of the internal combustion engine calculated from the time $T_1$ between detection of the generation position of the first negative voltage $V_{n1}$ and detection of the generation position of the second negative voltage $V_{n2}$ and an angle (determined by a construction of the generator) between the generation position of the first negative voltage $V_{n1}$ and the generation position of the second negative voltage $V_{n2}$ when the start completion determination means 24 determines that the internal combustion engine is at the start, as ignition position detecting counting data, and causing the ignition timer to immediately start measurement of the ignition position detecting counting data $T_{igs}$, when the generation position of the second negative voltage $V_{n2}$ is detected, and controls the ignition position of the internal combustion engine to a position suitable at the start.

The shown start time ignition control means 26 is comprised of start time ignition position detecting counting data arithmetical operation means 30 for arithmetically operating time required for the internal combustion engine to rotate from the generation position of the second negative voltage to the ignition position suitable at the start at the rotational speed of the internal combustion engine calculated from the elapsed time $T_1$ between detection of the generation position $CR_{in}$ of the first negative voltage $V_{n1}$ and detection of the generation position $CR_{out}$ of the second negative voltage $V_{n2}$ and an angle $\alpha$ (see FIG. 4) between the generation position $CR_{in}$ of the first negative voltage and the generation position $CR_{out}$ of the second negative voltage, as ignition position detecting counting data $T_{igs}$, ignition permission and prevention means 31, and ignition timer control means 32 for setting the ignition position detecting counting data $T_{igs}$ in the ignition timer that constitutes the ignition signal generation means 21 to start measurement thereof.

The start time ignition position detecting counting data $T_{igs}$ is arithmetically operated by the following equation $$T_{igs}=T_1\cdot(\theta_{out}-\theta_{igs})/\alpha \quad (1)$$

where $\theta_{out}$ is an angle between the top dead center position TDC and the generation position $CR_{out}$ of the second negative voltage $V_{n2}$, and the ignition position $\theta_{igs}$ at the start is expressed by an advance angle measured on the advance side from the top dead center position TDC.

In the present invention, the start time ignition position detecting counting data arithmetical operation means 30 is comprised so as to arithmetically operate ignition position detecting counting data regarding the measurement value $T_s$ of the timer in initial generation of the negative voltage (the elapsed time between the start of the operation of the microprocessor and initial generation of the negative voltage) as the time $T_1$ between generation of the first negative voltage $V_{n1}$ and generation of the second negative voltage $V_{n2}$, when the negative voltage determination means 23 determines that the negative voltage initially detected after the commencement of the start operation of the internal combustion engine is the second negative voltage $V_{n2}$.

The ignition permission and prevention means 31 determines whether the ignition operation is permitted or prevented at the start of the engine. The ignition permission and prevention means 31 unconditionally permits generation of the ignition signal when the internal combustion engine is in an initial state at the start, permits generation of the ignition signal at the start when the internal combustion engine is no longer in the initial state at the start, and a ratio $T_0/T_1$ between the time $T_0$ between detection of the second negative voltage and detection of the next first negative voltage and the time $T_1$ between detection of the first negative voltage and detection of the second negative voltage is equal to or higher than a set value, and prevents the generation of the ignition signal at the start when the internal combustion engine is no longer in the initial state at the start, and the ratio $T_0/T_1$ is lower than the set value.

In the embodiment, two ignition positions: an ignition position (a position near the top dead center position) $\theta_{igs1}$ suitable at the commencement of the start, and an ignition position (a position slightly advanced from the top dead center position) $\theta_{igs2}$ suitable as an ignition position in shifting to idling after the commencement of the start are previously set as ignition positions suitable at the start and stored in a ROM. The start time ignition position detecting counting data arithmetical operation means 30 selects an optimum ignition position as $\theta_{igs}$ between the two ignition positions $\theta_{igs1}$ and $\theta_{igs2}$ set as the ignition positions suitable at the start, according to the rotational speed arithmetically operated by the rotational speed arithmetical operation means 25, and arithmetically operates the start time ignition position detecting counting data $T_{igs}$ by the equation (1). When the start time ignition position detecting counting data $T_{igs}$ is arithmetically operated, the ignition timer control means 32 immediately sets the counting data $T_{igs}$ in the ignition timer to start measurement thereof.

Figure 4:
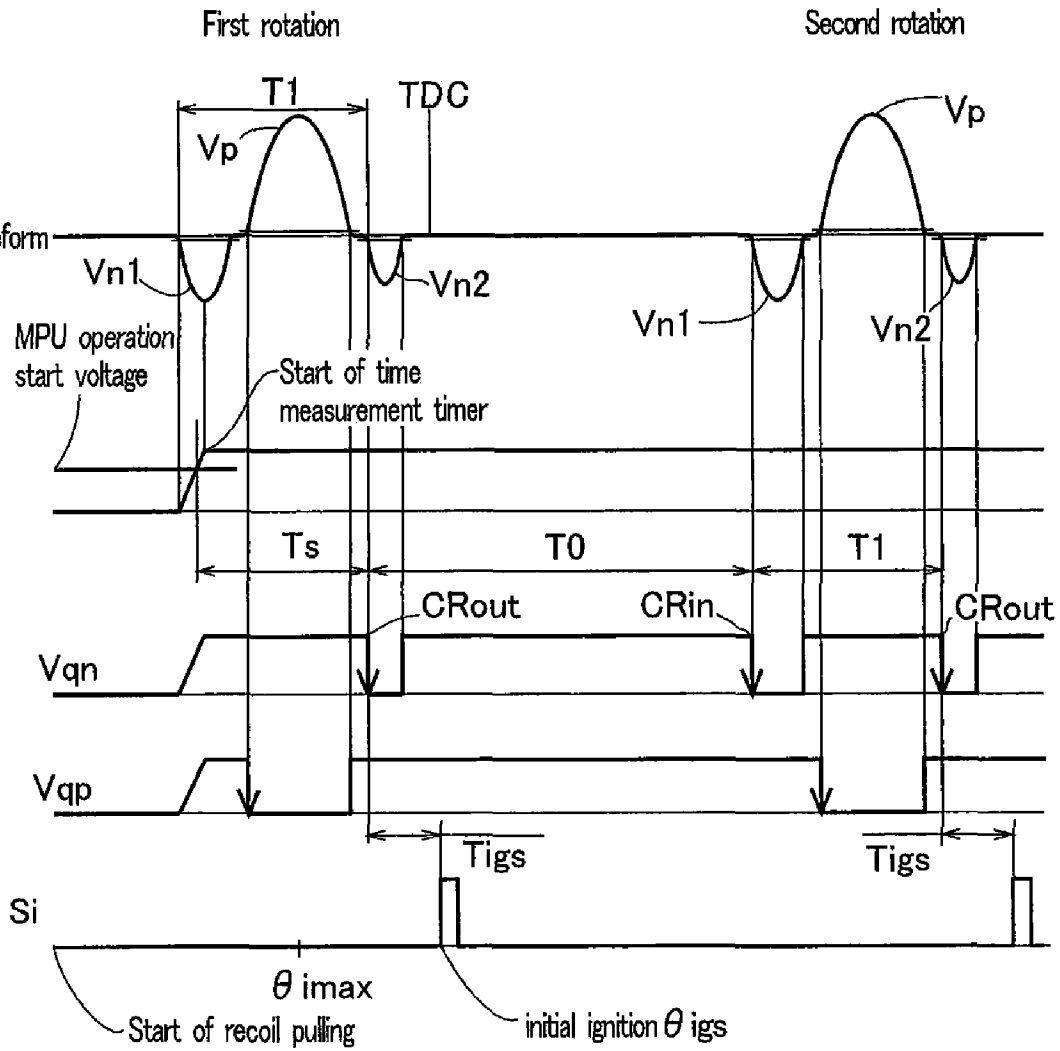
FIG. 4 is a waveform chart showing a waveform of a voltage output by an exciter coil immediately after the commencement of start operation, a waveform of a voltage output by a power supply circuit, a pulse waveform output by first and second waveform shaping circuits, and a waveform of an ignition signal in the embodiment of the present invention.

The process between capturing the time $T_1$ and arithmetically operating the start time ignition position detecting counting data $T_{igs}$ is performed instantaneously, and thus the measurement of the counting data $T_{igs}$ can be considered to be started in the generation position $CR_{out}$ of the second negative voltage $V_{n2}$. Thus, at the start of the engine, as shown in FIG. 4, the ignition signal is provided to the thyristor $T_{hi}$ of the ignition circuit 2 to perform the ignition operation in the crank angle position $\theta_{igs}$ at the time when time provided by the start time ignition position detecting counting data $T_{igs}$ has elapsed from the time of the detection of the generation position $CR_{out}$ of the second negative voltage $V_{n2}$.

As described above, the start time ignition control means is comprised so as to determine, when the negative voltage is initially detected after the commencement of the start operation of the internal combustion engine, whether the initially detected negative voltage is the first negative voltage or the second negative voltage, and when determining that the initially detected negative voltage is the second negative voltage, arithmetically operate the ignition position detecting counting data $T_{igs}$ regarding the time $T_s$ between the start of the operation of the microprocessor and initial detection of the second negative voltage as the time $T_1$ between detection of the first negative voltage and detection of the second negative voltage. Thus, as shown in FIG. 4, when the negative voltage initially detected after the commencement of the start operation is the second negative voltage $V_{n2}$, an initial ignition position can be detected with respect to a rotational speed substantially equal to an actual rotational speed of the engine for ignition operation immediately after the commencement of the start operation. Therefore, the probability that ignition can be performed at a proper crank angle position from the first rotation of the crankshaft can be increased to improve startability of the engine.

The idle time advance control condition determination means 27 determines whether an idle time advance control condition is met that is a condition for permitting idle time advance control to advance an ignition position during idling immediately after completion of the start of the internal combustion engine from an ignition position during idling in normal operation in order to stabilize idling immediately after completion of the start of the internal combustion engine.

In the embodiment, the idle time advance control condition determination means 27 is comprised so as to determine that the idle time advance control condition is met when the number of ignitions by the idle time advance control means 28 is equal to or smaller than a set value, and determine that the idle time advance control condition is not met when the number of ignitions by the idle time advance control means 28 exceeds the set value. Specifically, in the embodiment, the idle time advance control is restricted by the number of ignitions so that the idle time advance control is finished when the number of ignitions by the idle time advance control reaches the set value.

The idle time advance control means 28 controls the generation position of the ignition signal so as to advance the ignition position during idling immediately after completion of the start of the internal combustion engine from the ignition position during idling in normal operation when the idle time advance control condition determination means 27 determines that the idle time advance control condition is met (the idle time advance control is permitted).

The shown idle time advance control means 28 is comprised of idle time advance control time ignition position arithmetical operation means 33 for arithmetically operating an idle time advance controlling ignition position $\theta_{igi}$ at an idling speed of the internal combustion engine calculated from the cycle $T_2$ of detection of the generation position $CR_{in}$ of the first negative voltage $V_{n1}$, as a position advanced from the ignition position at the idling speed in normal operation of the internal combustion engine; ignition position detecting counting data arithmetical operation means 34 for idle time advance control for arithmetically operating time required for the internal combustion engine to rotate from the detection position of the first negative voltage $V_{n1}$ to the idle time advance controlling ignition position $\theta_{igi}$ at the idling speed of the internal combustion engine calculated from the cycle $T_2$ of detection of the generation position $CR_{in}$ of the first negative voltage $V_{n1}$, as ignition position detecting counting data $T_{igi}$; and ignition timer control means 35 for setting the ignition position detecting counting data $T_{igi}$ in the ignition timer when the generation position of the second negative voltage $V_{n2}$ is detected to start measurement of the counting data $T_{igi}$. The idle time advance control means 28 performs control to advance the ignition position during idling immediately after completion of the start from the ignition position during idling in normal operation when the idle time advance control condition is met.

The idle time advance control time ignition position arithmetical operation means 33 used in the embodiment searches an ignition position arithmetical operation map for normal operation for arithmetically operating the ignition position in normal operation with respect to the idling speed of the internal combustion engine calculated from the cycle $T_2$ of detection of the generation position $CR_{in}$ of the first negative voltage $V_{n1}$, and arithmetically operates the idle time advance controlling ignition position $\theta_{igi}$ by adding a certain advance angle to an advance angle (an angle measured on the advance side from the top dead center) that provides an ignition position at the calculated idling speed in normal operation.

The normal operation time ignition control means 29 controls the generation position of the ignition signal so that when the start completion determination means 24 determines that the internal combustion engine has completed the start, and the idle time advance control condition determination means 27 determines that the idle time advance control condition is not met, the ignition position is set in a position suitable in normal operation of the internal combustion engine.

The normal operation time ignition control means 29 is comprised so as to perform a process of arithmetically operating an ignition position $\theta_{ign}$ in normal operation of the internal combustion engine with respect to the rotational speed of the internal combustion engine calculated from the cycle $T_2$ of detection of the generation position $CR_{in}$ of the first negative voltage $V_{n1}$, a process of arithmetically operating time required for the engine to rotate from the generation position of the first negative voltage $V_{n1}$ to the arithmetically operated ignition position $\theta_{ign}$ in normal operation at the rotational speed of the internal combustion engine calculated from the cycle $T_2$, as ignition position detecting counting data $T_{ign}$, and a process of causing the ignition timer to start measurement of the ignition position detecting counting data $T_{ign}$, when the first negative voltage is detected.

The shown normal operation time ignition control means 29 is comprised of ignition position arithmetical operation means (not shown) for arithmetically operating the ignition position $\theta_{ign}$ in normal operation of the internal combustion engine with respect to the rotational speed arithmetically operated by the rotational speed arithmetical operation means 25 using the cycle $T_2$ detected one rotation before, normal time ignition position detecting counting data arithmetical operation means 36 for arithmetically operating time required for the engine to rotate from the generation position $CR_{in}$ of the first negative voltage to the arithmetically operated ignition position $\theta_{ign}$ in normal operation at the present rotational speed of the internal combustion engine calculated from a newly measured cycle $T_2$, as ignition position detecting counting data $T_{ign}$, and ignition timer control means 37 for setting measurement of the arithmetically operated ignition position detecting counting data $T_{ign}$ in the ignition timer that constitutes the ignition signal generation means 21 to start measurement thereof.

The normal operation time ignition position detecting counting data $T_{ign}$ is arithmetically operated by the following equation $$T_{ign}=T_2\cdot(\theta_{in}-\theta_{ign})/360 \quad (2)$$

where $\theta_{in}$ is an angle between the top dead center position TDC and the generation position $CR_{in}$ of the first negative voltage $V_{n1}$, and the ignition position $\theta_{ign}$ is expressed by an angle measured on the advance side from the top dead center position.

The ignition timer control means 35 sets the ignition position detecting counting data $T_{ign}$ in the ignition timer that constitutes the ignition signal generation means 21 to start measurement thereof. The ignition signal generation means 21 provides the ignition signal $S_i$ to the discharge switch and causes the ignition circuit 2 to perform the ignition operation when the ignition timer completes the measurement of the set counting data $T_{ign}$.

Thus, in normal operation of the engine, the ignition signal $S_i$ is provided to the thyristor $T_{hi}$ of the ignition circuit in the crank angle position $\theta_{ign}$ at the time when time provided from the normal operation time ignition position detecting counting data $T_{ign}$ has passed from the time when the generation position $CR_{in}$ of the first negative voltage $V_{n1}$ is detected, to perform the ignition operation. The ignition position $\theta_{ign}$ changes with changes in control conditions such as the rotational speed of the engine.

In FIG. 4, $\theta_{imax}$ denotes a maximum advance position of the ignition position in normal operation. In order to perform the ignition operation in the maximum advance position without problems, in the maximum advance position $\theta_{imax}$, the relationship between a phase of the output voltage of the exciter coil and the maximum advance position is set so that an instantaneous value of the positive voltage $V_p$ of the exciter coil has a value that can charge the ignition capacitor $C_i$ to a voltage value that allows the ignition operation. In the embodiment, a peak position of the positive voltage $V_p$ output by the exciter coil is set to be the maximum advance position.

Figure 5:
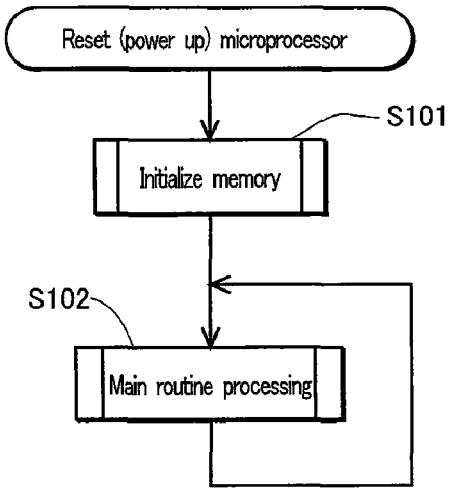
FIG. 5 is a flowchart showing an algorithm of a processing performed when a microprocessor is powered on in the first embodiment of the present invention.

In the embodiment, FIGS. 5 to 12 show algorithms of essential portions of programs performed by the microprocessor 3. FIG. 5 shows an algorithm of a processing performed when the microprocessor is reset (powered up). In this processing, first in Step S101, a memory is initialized, then the process moves to Step S102, and a processing of a main routine is performed.

In the main routine, an arithmetical operation or the like of the ignition position $\theta_{ign}$ in normal time is performed with respect to a rotational speed $N_e$ arithmetically operated in a $CR_{in}$ processing in FIG. 10 described later. The arithmetical operation of the ignition position $\theta_{ign}$ is performed, for example, by searching the ignition position arithmetical operation map stored in the ROM with respect to the rotational speed $N_e$, and performing interpolation of the searched value. Also, an arithmetical operation for correcting the ignition position is performed with respect to other control conditions such as a throttle valve opening as required.

Figure 6:
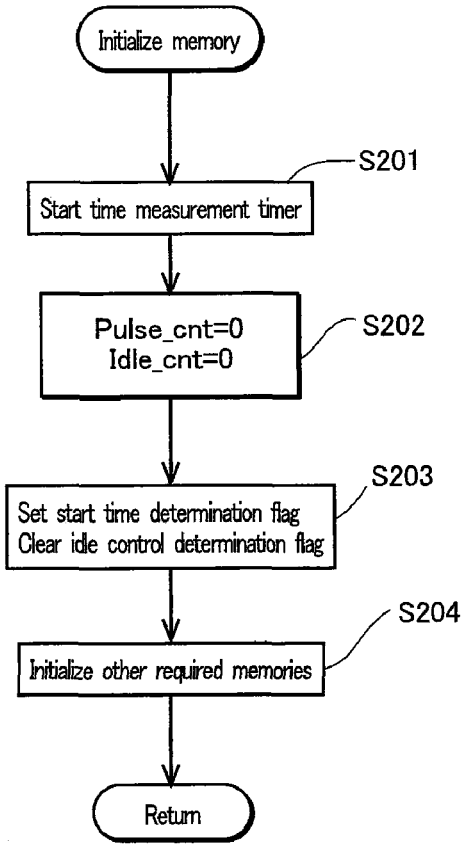
FIG. 6 is a flowchart showing an algorithm of a memory initialization processing performed immediately after activation of the microprocessor in the first embodiment of the present invention.

FIG. 6 shows an algorithm of a memory initialization processing. In this initialization process, first in Step S201, a counting operation of the timer provided in the microprocessor is started. Then, in Step S202, the number of rotations Pulse_cnt of the crankshaft of the engine after the commencement of the start operation of the internal combustion engine is cleared to zero, and a count value Idle_cnt of an idle time advance control ignition number counter is cleared to zero. In the embodiment, the number of detections of the generation position ($CR_{in}$) of the first negative voltage $V_{n1}$ is counted as the number of rotations Pulse_cnt. In Step S202, the number of rotations Pulse_cnt and the count value Idle_cnt of the idle time advance control ignition number counter are cleared to zero, then in Step S203, a start time determination flag is set to "start time", and an idle time advance control determination flag is cleared. In Step S204, other memories are initialized.

Figure 7:
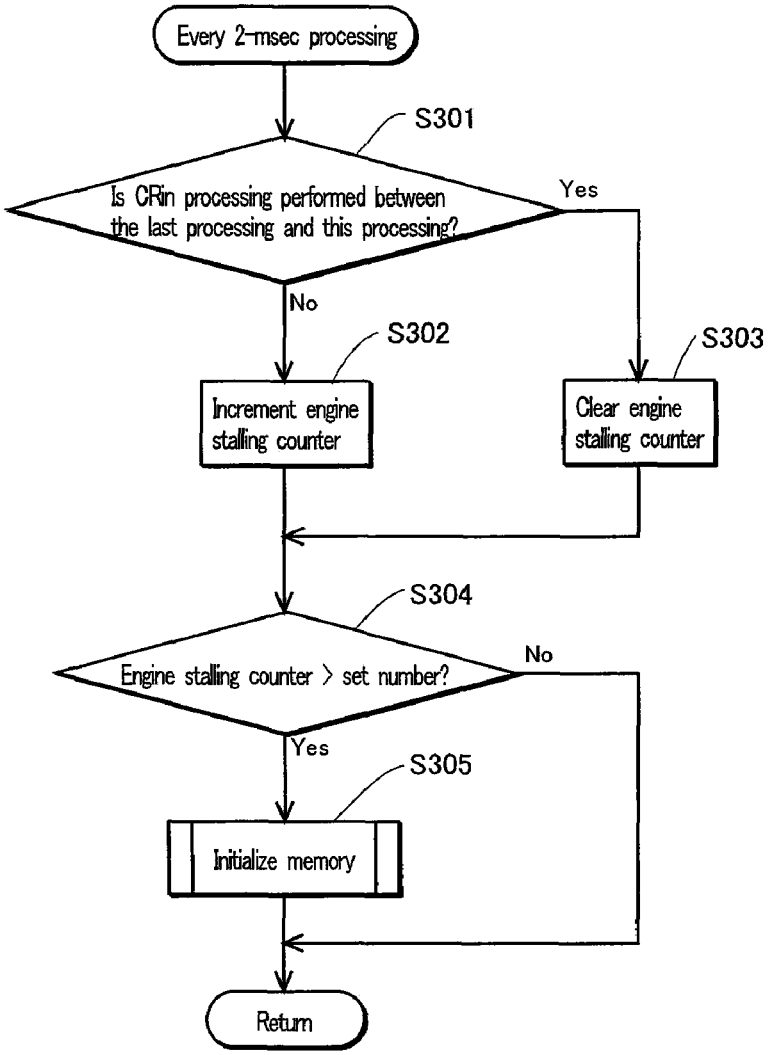
FIG. 7 is a flowchart showing an algorithm of a processing performed by the microprocessor every 2 msec in the first embodiment of the present invention.

FIG. 7 shows an algorithm of an every 2-msec processing (a memory initialization processing in engine stalling) performed every 2 msec by the microprocessor in order to determine whether the internal combustion engine stalls. In this processing, first in Step S301, it is determined whether the $CR_{in}$ processing described later is performed between the last every 2-msec processing and this every 2-msec processing. When it is determined that the $CR_{in}$ processing is not performed between the last every 2-msec processing and this every 2-msec processing, the process moves to Step S302, and a count value of an engine stalling counter that counts the number of engine stalling is incremented. When it is determined in Step S301 that the $CR_{in}$ processing is performed between the last every 2-msec processing and this every 2-msec processing, the process moves to Step S303 and the count value of the engine stalling counter is cleared. After Step S302 or S303, the process moves to Step S304, and it is determined whether the count value of the engine stalling counter exceeds a set number. When it is determined that the count value of the engine staffing counter does not exceed the set number, it is determined the engine does not stall, returning to the main routine. When it is determined in Step S304 that the count value of the engine stalling counter exceeds the set number, the process moves to Step S305, the memory initialization processing in FIG. 6 is performed, then returning to the main routine.

Figure 8:
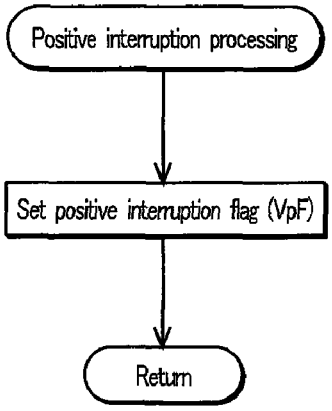
FIG. 8 is a flowchart showing an algorithm of a positive interruption processing performed for each output of a positive voltage by the exciter coil in the first embodiment of the present invention.

FIG. 8 shows a positive interruption processing performed by the microprocessor for each detection of the trailing edge of the rectangular wave signal $V_{qp}$ output by the second waveform shaping circuit 4*b* (for each generation of the positive voltage). In this interruption processing, a positive voltage detection flag $V_pF$ is set, then returning to the main routine.

Figure 9:
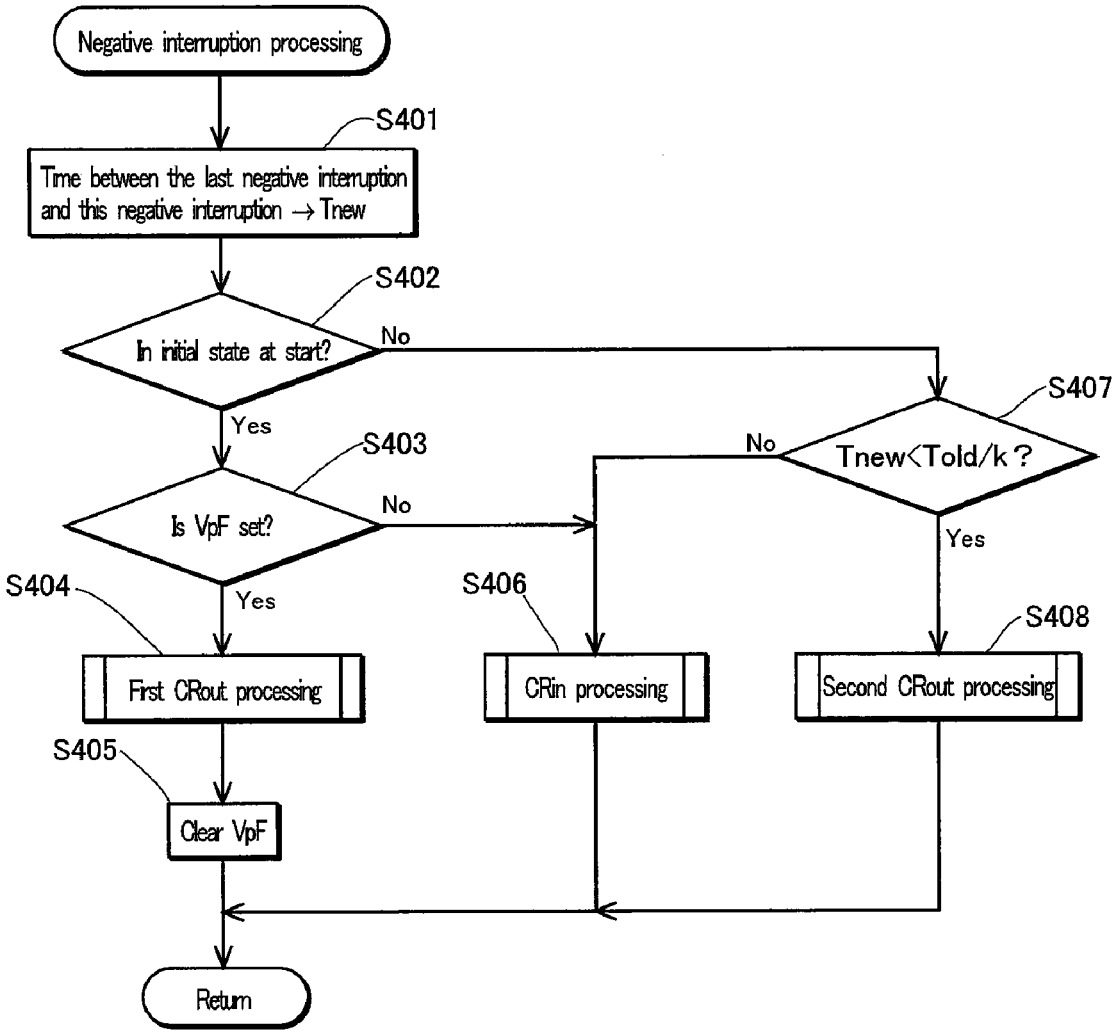
FIG. 9 is a flowchart showing an algorithm of a negative interruption processing performed by the microprocessor for each detection of a negative voltage output by the exciter coil in the first embodiment of the present invention.
Figure 11:
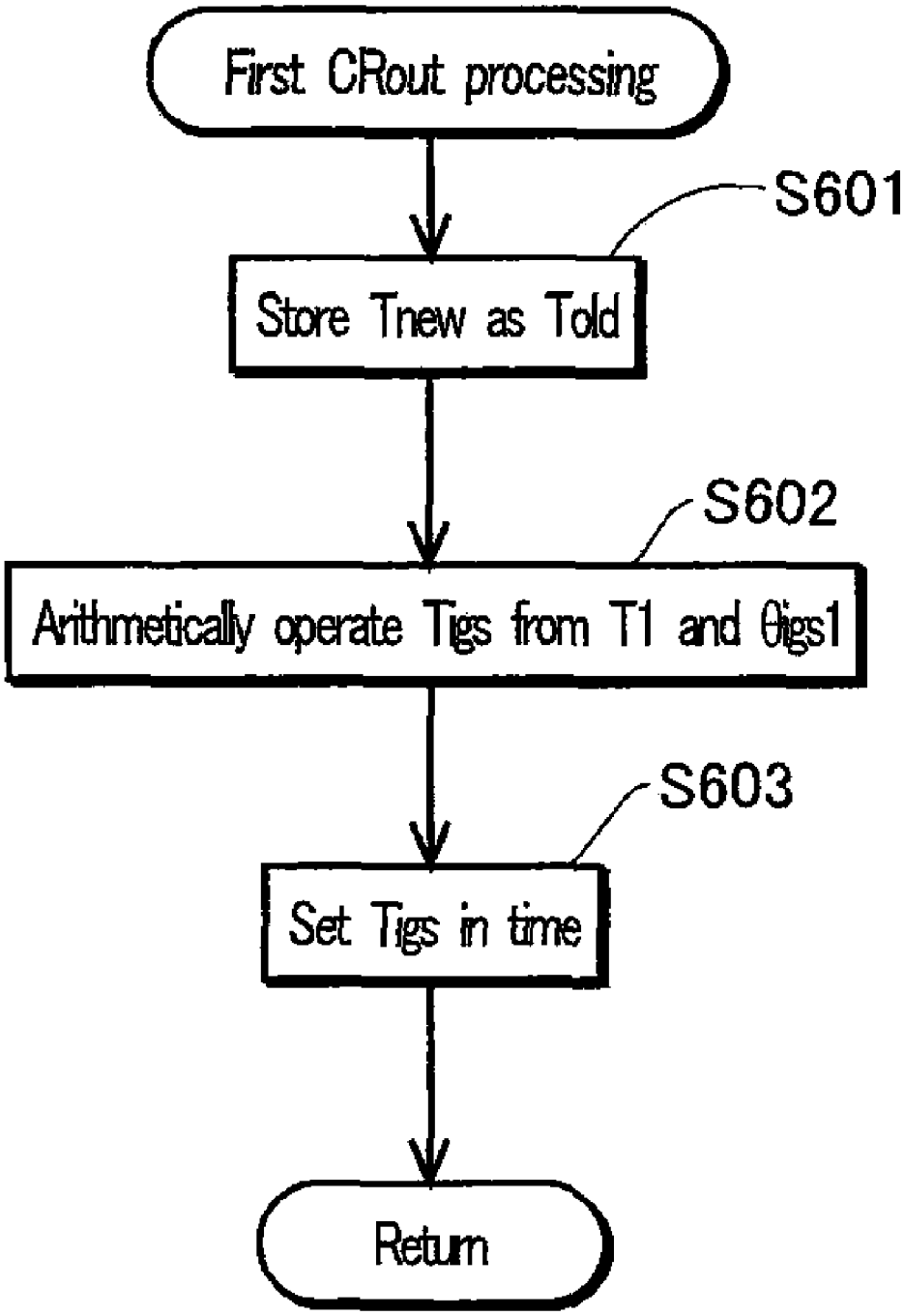
FIG. 11 is a flowchart showing an algorithm of a first $CR_{out}$ processing performed when a second negative voltage is detected in an initial state immediately after the commencement of the start operation in the first embodiment of the present invention.
Figure 12:
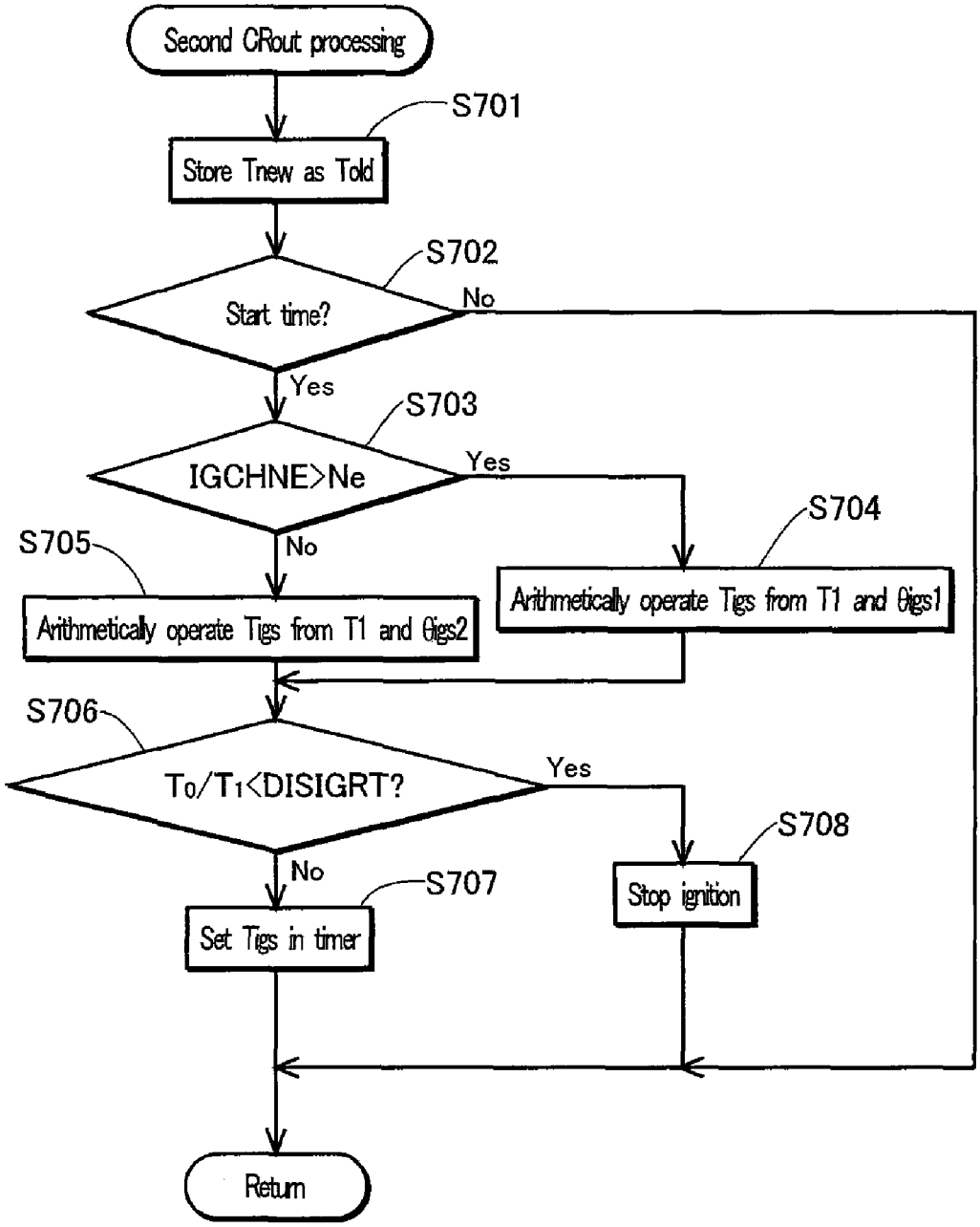
FIG. 12 a flowchart showing an algorithm of a second $CR_{out}$ processing performed by the microprocessor for each detection of a generation position $CR_{out}$ of the second negative voltage output by the exciter coil when the engine is no longer in the initial state at the start in the first embodiment of the present invention.

FIG. 9 shows a negative interruption processing performed for each detection of the exciter coil generating the negative voltages $V_{n1}$ and $V_{n2}$. FIG. 10 shows a $CR_{in}$ processing performed when it is determined that the negative voltage generated this time in the negative interruption processing in FIG. 9 is the first negative voltage (when the generation position $CR_{in}$ of the first negative voltage is detected). FIG. 11 shows a first $CR_{out}$ processing performed when the engine is in an initial state at the start (a state immediately after the commencement of the start operation), and it is determined that the negative voltage initially detected after the start of the operation of the microprocessor is the second negative voltage $V_{n2}$ (when the generation position $CR_{out}$ of the second negative voltage is detected) in the negative interruption processing in FIG. 9. FIG. 12 shows a second $CR_{out}$ processing performed when the engine is no longer in the initial state at the start, and it is determined that the negative voltage detected by the microprocessor is the second negative voltage $V_{n2}$ (when the generation position $CR_{out}$ of the second negative voltage is detected) in the negative interruption processing in FIG. 9.

When the microprocessor 3 detects the generation position $CR_{in}$ of the first negative voltage and the generation position $CR_{out}$ of the second negative voltage, the main routine is interrupted, and the negative interruption processing in FIG. 9 is started. In Step S401 of the interruption processing, an elapsed time between the last negative interruption processing and this negative interruption processing is stored in a RAM as $T_{new}$. Then, the process proceeds to Step S402, and it is determined whether the engine is in the initial state at the start.

In the determination whether the engine is in the initial state at the start, for example, it is determined that the internal combustion engine is in the initial state at the start when the number of ignition operations performed after the commencement of the start operation of the internal combustion engine is smaller than a set value that is set to a sufficiently small value, and determine that the internal combustion engine is no longer in the initial state when the number of ignition operations performed after the commencement of the start operation of the internal combustion engine is equal to or larger than the set value. The set value of the number of ignition operations used for determining whether the engine is in the initial state at the start is set to, for example, one.

In the determination in Step S402, it may be determined that the internal combustion engine is in the initial state at the start when the rotational speed of the internal combustion engine calculated from time between detection of the first negative voltage and detection of the second negative voltage is lower than a set value, and it may be determined that the internal combustion engine is no longer in the initial state at the start when the rotational speed of the internal combustion engine calculated from time between detection of the first negative voltage and detection of the second negative voltage is equal to or higher than the set value (for example, 300 rpm).

When it is determined in Step S402 that the engine is in the initial state at the start, the process moves to Step S403, and it is determined whether the positive voltage detection flag $V_pF$ is set. When it is determined that the positive voltage detection flag $V_pF$ is set, a first $CR_{out}$ processing is performed in Step S404, and then in Step S405, the positive voltage detection flag $V_pF$ is cleared, returning to the main routine.

Figure 10:
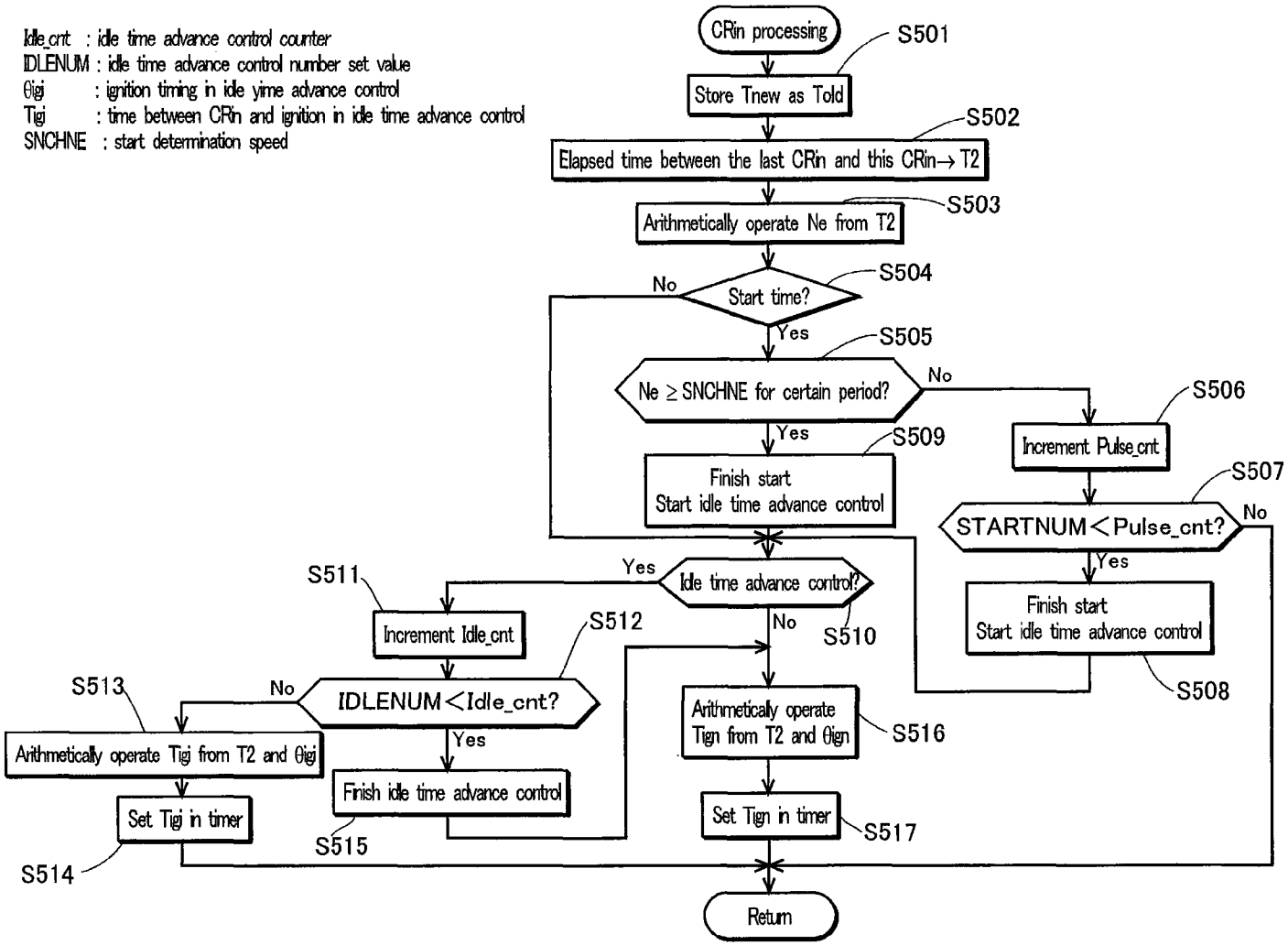
FIG. 10 is a flowchart showing an algorithm of a $CR_{in}$ processing performed by the microprocessor for each detection of a generation position $CR_{in}$ of a first negative voltage output by the exciter coil in the first embodiment of the present invention.

When it is determined in Step S403 of the negative interruption processing in FIG. 9 that the positive voltage detection flag $V_pF$ is not set, the process proceeds to Step S406, and the $CR_{in}$ processing in FIG. 10 is performed, then returning to the main routine. When it is determined in Step S402 in FIG. 9 that the engine is no longer in the initial state at the start, the process moves to Step S407, the elapsed time $T_{new}$ measured this time is compared with time $T_{old}/k$ obtained by multiplying time similarly measured and stored in the last negative interruption processing and determined as $T_{old}$ at the finish of the interruption processing by 1/k. When it is determined from the comparison that $T_{new}<T_{old}/k$ is not met ($T_{new}\geqq T_{old}/k$), it is determined that the crank angle position where this negative interruption processing is started is the generation position of the first negative voltage, the process proceeds to Step S406, and the $CR_{in}$ processing in FIG. 10 is performed. When it is determined in Step S407 that $T_{new}<T_{old}/k$ is met, it is determined that the crank angle position where this interruption processing is started is the generation position of the second negative voltage, the process proceeds to Step S408, and the second $CR_{out}$ processing in FIG. 12 is performed, then returning to the main routine.

In the $CR_{in}$ processing in FIG. 10, first in Step S501, the time $T_{new}$ measured in Step 1 of the interruption processing in FIG. 9 is stored as $T_{old}$, and in Step S502, an elapsed time between the last $CR_{in}$ processing and this $CR_{in}$ processing is arithmetically operated as $T_2$. Then, in Step S503, the rotational speed $N_e$ of the engine is arithmetically operated from the elapsed time $T_2$ (time required for one rotation of the crankshaft), and it is determined in Step S504 whether the start time determination flag is set to "start time". When it is determined in Step S504 that the start time determination flag is set to "start time", the process proceeds to Step S505, and it is determined whether the rotational speed of the engine is equal to or higher than a start determination speed SNCHNE continuously for a certain period. When it is determined that the rotational speed of the engine is not equal to or higher than the start determination speed continuously for a certain time, the process proceeds to Step S506, the number of rotations Pulse_cnt of the crankshaft after the commencement of the start operation of the engine is incremented by one, and it is determined in Step S507 whether the number of rotations Pulse_cnt exceeds a set number STARTNUM. When the number of rotations Pulse_cnt does not exceed the set number STARTNUM, the $CR_{in}$ processing is finished without performing any processing thereafter, returning to the main routine.

When it is determined in Step S507 that the number of rotations Pulse_cnt exceeds the set number STARTNUM, in Step S508, the ignition control at the start is finished, and the idle time advance control flag is set to start the idle time advance control. When it is determined in Step S505 that the rotational speed of the engine is equal to or higher than the start determination speed continuously for a certain period, in Step S509, the start time determination flag is cleared to finish the ignition control at the start, and the idle time advance control flag is set to start the idle time advance control.

When the idle time advance control is started in Step S508, when the idle time advance control is started in Step S509, and when it is determined in Step S504 that the start time determination flag is not set at the start, then it is determined in S510 whether the idle time advance control flag is set (whether the idle time advance control is performed). When it is determined that the idle time advance control flag is set, the process moves to Step S511. In Step S511, the count value Idle_cnt of the idle time advance control counter is incremented by one, and then in Step S512, it is determined whether the count value Idle_cnt of the idle time advance control counter exceeds an idle time advance control number set value IDLENUM. When it is determined that the count value Idle_cnt of the idle time advance control counter does not exceed the idle time advance control number set value IDLENUM (when the idle time advance control condition is met), the process proceeds to Step S513, and time required for the crankshaft to rotate from the generation position of the first negative voltage $V_{n1}$ to the ignition position $\theta_{igi}$ is arithmetically operated as ignition position detecting counting data $T_{igi}$ from a rotational speed calculated from the cycle $T_2$ of detection of the generation position of the first negative voltage $V_{n1}$ and an angle of 360° of one rotation of the crankshaft, and the idle time advance controlling ignition position $\theta_{igi}$. Then, in Step S514, the ignition position detecting counting data $T_{igi}$ is set in the ignition timer, and the $CR_{in}$ processing in FIG. 10 is finished. The ignition position detecting counting data $T_{igi}$ in the idle time advance control is arithmetically operated by the following equation $$T_{igi}=T_2\cdot(\theta_{in}-\theta_{igi})/360 \quad (3)$$

where $\theta_{in}$ is an angle between the top dead center position TDC and the generation position $CR_{in}$ of the first negative voltage $V_{n1}$, and the ignition position $\theta_{igi}$ is expressed by an angle measured on the advance side from the top dead center position.

In Step S512, when it is determined that the count value Idle_cnt of the idle time advance control counter exceeds the idle time advance control number set value IDLENUM, the process proceeds to Step S515, the idle time advance control flag is cleared to finish the idle time advance control. In Step S515, a processing for finishing the idle time advance control (clearing the idle time advance control flag) is performed, then the process moves to Step S516, the ignition position detecting counting data $T_{ign}$ is arithmetically operated by the equation (2) using the generation cycle $T_2$ (the elapsed time for one rotation of the crankshaft) of the first negative voltage $V_{n1}$, the rotational speed $N_e$ arithmetically operated in the last $CR_{in}$ processing, and the ignition position $\theta_{ign}$ in normal operation arithmetically operated in the main routine, and in Step S517, the counting data $T_{ign}$ is set in the ignition timer to start measurement thereof. When the ignition timer completes the measurement of the set counting data, an unshown interruption processing is performed, and an ignition signal is provided to the discharge switch (thyristor $T_{hi}$) of the ignition circuit.

As described above, in the embodiment, when it is determined that the number of rotations Pulse_cnt of the crankshaft after the commencement of the start operation exceeds the set number STARTNUM even if the rotational speed of the engine does not reach the start determination speed, it is determined that the engine is not at the start, the ignition control at the start is finished, and the idle time advance control is started.

Then, in the first $CR_{out}$ processing in FIG. 11, first in Step S601, the elapsed time $T_{new}$ between crank signals (elapsed time between the start of the operation of the microprocessor and initial detection of the negative voltage) measured this time is stored as the elapsed time $T_{old}$ between crank signals measured last time. Then, in Step S602, the elapsed time between the start of the operation of the microprocessor and initial detection of the negative voltage is regarded as the elapsed time $T_1$ between the generation of the first negative voltage and the generation of the second negative voltage, and ignition position detecting counting data $T_{igs}$ for detecting the initial ignition position is arithmetically operated using the rotational speed of the engine calculated from the elapsed time $T_1$ and an angle (a fixed value) between the generation position of the first negative voltage and the generation position of the second negative voltage, and a start time ignition position $\theta_{igs1}$ set near the top dead center position. Then in Step S603, the ignition position detecting counting data $T_{igs}$ is set in the ignition timer to start measurement thereof, then returning to the main routine. When the ignition timer finishes the measurement of the set counting data, an unshown interruption processing is performed to generate the first ignition signal $S_i$.

In the second $CR_{out}$ processing in FIG. 12, first in Step S701, the elapsed time $T_{new}$ between crank signals measured this time is stored as the elapsed time $T_{old}$ between crank signals measured last time. Then, the process proceeds to Step S702, and it is determined whether the start time determination flag is set to "start time". When it is determined that the start time determination flag is set to "start time" (when it is determined that the engine is at the start), the process proceeds to Step S703, and it is determined whether the arithmetically operated rotational speed $N_e$ is lower than a set rotational speed IGCHNE. When it is determined that the rotational speed $N_e$ is lower than the set rotational speed IGCHNE, the process proceeds to Step S704, ignition position detecting counting data $T_{igs}$ at the start is arithmetically operated using the elapsed time $T_1$ (the elapsed time between crank signals measured when the crank interruption processing in FIG. 12 is started) between the detection of the first negative voltage and the detection of the second negative voltage, and a first start time ignition position $\theta_{igs1}$ set near the top dead center position of the engine. On the other hand, when it is determined in Step S703 that the rotational speed $N_e$ is equal to or higher than the set rotational speed IGCHNE, the process proceeds to Step S705, the ignition position detecting counting data $T_{igs}$ at the start is arithmetically operated using the elapsed time $T_1$ and a second start time ignition position $\theta_{igs2}$ set in a position slightly advanced from the top dead center position of the engine (an ignition position suitable as an ignition position in idling).

After Step S704 or 5705, the process proceeds to Step S706, it is determined whether a ratio $T_0/T_1$ between the time $T_0$ between detection of the second negative voltage and detection of the next first negative voltage and the time $T_1$ between detection of the first negative voltage and detection of the second negative voltage is lower than a set value DISIGRT. When it is determined that the ratio $T_0/T_1$ is not lower than the set value DISIGRT, the process proceeds to Step S707, the counting data $T_{igs}$ arithmetically operated in Step S704 or S705 is set in the ignition timer, and the $CR_{out}$ processing is finished. When it is determined in Step S706 that the ratio $T_0/T_1$ is lower than the set value DISIGRT, the process proceeds to Step S708, the counting data $T_{igs}$ arithmetically operated in Step S704 or 5705 is prevented from being set in the ignition timer, the ignition operation is stopped, and then the $CR_{out}$ processing is finished. When it is determined in Step S702 that the start time determination flag is not set to "start time", the $CR_{out}$ processing is finished without performing any processing thereafter.

In the embodiment, the counting operation start means 38 in FIG. 3 is comprised by Step S201 in FIG. 6, and the elapsed time measurement means 22 in FIG. 3 is comprised by Step S401 of the interruption processing in FIG. 9. The negative voltage determination means 23 is comprised by Steps S403 and S407 of the interruption processing in FIG. 9. Further, the start completion determination means 24 is comprised by Step S202 of the memory initialization processing in FIG. 6, Steps S504, S505, S506 and S507 of the $CR_{in}$ processing in FIG. 10, and Steps S702 and S703 of the second $CR_{out}$ processing in FIG. 12, and the rotational speed arithmetical operation means 25 is comprised by Step S503 of the $CR_{in}$ processing in FIG. 10.

The start time ignition position detecting counting data arithmetical operation means 30 is comprised by Steps S704 and S705 of the $CR_{out}$ processing in FIG. 12, and the ignition permission and prevention means 31 is comprised by Steps S706 and S708 of the $CR_{out}$ processing in FIG. 12. Further, the ignition timer control means 32 is comprised by Step S707 of the $CR_{out}$ processing in FIG. 12. The normal time ignition position detecting counting data arithmetical operation means 36 is comprised by Step S516 of the $CR_{in}$ processing in FIG. 10, and the ignition timer control means 37 is comprised by Step S517 in FIG. 10.

Further, the idle time advance control condition determination means 27 is comprised by Step S512 of the $CR_{in}$ processing in FIG. 10, and the ignition position detecting counting data arithmetical operation means 34 for the idle time advance control is comprised by Step S513 of the $CR_{in}$ processing in FIG. 10. The ignition timer control means 35 is comprised by Step S514 of the $CR_{in}$ processing in FIG. 10.

As described above, in the ignition device of the embodiment, when the negative voltage is initially detected after the commencement of the start operation of the engine and the establishment of the output voltage of the power supply circuit 5, it is determined whether the negative voltage is the first negative voltage or the second negative voltage, and when it is determined that the initially detected negative voltage is the second negative voltage, the ignition position detecting counting data $T_{igs}$ is arithmetically operated regarding the time $T_s$ between the start of the operation of the microprocessor and initial generation of the second negative voltage as the time $T_1$ between generation of the first negative voltage and generation of the second negative voltage. Thus, as shown in FIG. 4, when the negative voltage initially detected after the commencement of the start operation is the second negative voltage $V_{n2}$, an initial ignition position can be detected according to a rotational speed substantially equal to an actual rotational speed of the engine for ignition operation immediately after the commencement of the start operation. Therefore, the probability that ignition can be performed at a proper crank angle position from the first rotation of the crankshaft can be increased to improve startability of the engine.

In the present invention, when the internal combustion engine is at the start, information on the rotational speed of the engine obtained from the elapsed time $T_1$ between detection of the generation position $CR_{in}$ of the first negative voltage and detection of the generation position $CR_{out}$ of the second negative voltage is used to calculate the counting data $T_{igs}$ for detecting the ignition position at the start of the engine, and the measurement of the counting data $T_{igs}$ is immediately started to generate the ignition signal at the start. Then, at the start of the engine when the rotational speed of the crankshaft of the engine minutely varies, the ignition position at the start can be detected based on rotational speed information calculated immediately before the ignition position at the start. Thus, the ignition position at the start can be precisely detected to improve startability of the engine.

Comprised as described above, the ignition position at the start of the engine can be set in a position delayed from the generation position $CR_{out}$ of the second negative voltage (a position beyond a section where the exciter coil generates the AC voltage), and thus a wide advance width of the ignition position can be obtained.

In the embodiment, when it is determined that the engine is at the start, the ignition permission and prevention means 31 unconditionally permits generation of the ignition signal when the internal combustion engine is in the initial state at the start, permits generation of the ignition signal at the start when the internal combustion engine is no longer in the initial state at the start, and a ratio $T_0/T_1$ between the time $T_0$ between detection of the second negative voltage and detection of the next first negative voltage and the time $T_1$ between detection of the first negative voltage and detection of the second negative voltage is equal to or higher than the set value, and prevents the generation of the ignition signal at the start when the internal combustion engine is no longer in the initial state at the start, and the ratio $T_0/T_1$ is lower than the set value. Thus, after the commencement of the start operation, the ignition operation can be prevented when a cranking speed is reduced by an insufficient operation force, thereby preventing a phenomenon (kickback) in which a piston cannot exceed the top dead center and is pushed back when the engine is manually started, and thus increasing safety. The set value compared with the ratio $T_0/T_1$ of the elapsed times is set to such a value that the relationship of $T_0/T_1$<set value is met when the cranking speed is insufficient to the level at which the kickback may occur.

The ignition permission and prevention means may be comprised so as to permit generation of the ignition signal at the start when the time $T_1$ between detection of the generation position $CR_{in}$ of the first negative voltage and detection of the generation position $CR_{out}$ of the second negative voltage is shorter than the set value, and prevent the generation of the ignition signal at the start when the time $T_1$ exceeds the set value.

In the embodiment, when it is determined that the internal combustion engine has completed the start, and when it is determined that the number of rotations Pulse_cnt of the engine after the commencement of the start operation exceeds the set number STARTNUM though the start of the engine has not been completed, the idle time advance control is started before shifting to the ignition control in normal operation, time required for the engine to rotate from the reference crank angle position to the idle time advance controlling ignition position $\theta_{igi}$ is arithmetically operated as the ignition position detecting counting data $T_{igi}$ using the present rotational speed detected from the cycle $T_2$ of detection of the generation position of the first negative voltage measured in the generation position $CR_{in}$ of the first negative voltage (the reference crank angle position), and the counting data is measured by the ignition timer to generate the ignition signal for the idle time advance control.

In the embodiment, the ignition position having an advance angle obtained by adding a certain advance angle to an advance angle that provides the ignition position at the idling speed in normal operation arithmetically operated with respect to the idling speed of the internal combustion engine calculated from the cycle $T_2$ of detection of the generation position of the first negative voltage $V_{n1}$ (the position advanced from the ignition position at the idling speed in normal operation of the internal combustion engine) is the idle time advance controlling ignition position $\theta_{igi}$.

In the present invention, the idle time advance control time ignition position arithmetical operation means 33 is not exclusively comprised as described above. For example, the idle time advance control time ignition position arithmetical operation means 33 may be comprised so that an ignition position arithmetical operation map exclusive to the idle time advance control is prepared, and the idle time advance controlling ignition position $\theta_{igi}$ is arithmetically operated by searching the ignition position arithmetical operation map exclusive to the idle time advance control with respect to the idling speed of the internal combustion engine calculated from the cycle $T_2$ of detection of the generation position of the first negative voltage $V_{n1}$. Also, the idle time advance control time ignition position may be a fixed value without providing the idle time advance control time ignition position arithmetical operation means 33.

The idle time advance control is performed until the count value Idle_cnt of the idle time advance control ignition number counter reaches the set value IDLENUM (until the ignition in the idle time advance controlling ignition position $\theta_{igi}$ is performed a set number of times). When the count value Idle_cnt of the idle time advance control ignition number counter exceeds the set value IDLENUM, in Step S515 of the $CR_{in}$ processing in FIG. 10, the idle time advance control flag is cleared to finish the idle time advance control, shifting to the ignition control in normal operation.

In the ignition control in normal operation, time required for the engine to rotate from the generation position of the first negative voltage $V_{n1}$ to the ignition position in normal operation having been arithmetically operated (the ignition position arithmetically operated with respect to the control conditions including the rotational speed arithmetically operated one rotation before) $\theta_{ign}$ is arithmetically operated as the ignition position detecting counting data $T_{ign}$ using the rotational speed calculated from the cycle $T_2$ in this generation position of the first negative voltage $V_{n1}$, and the counting data is measured by the ignition timer to generate the ignition signal. Thus, in normal operation of the engine, the engine is ignited in the ignition position arithmetically operated with respect to the rotational speed and corrected with respect to other control conditions as required.

As described above, the idle time advance control means is provided for controlling the generation position of the ignition signal so as to advance the ignition position of the internal combustion engine from the ignition position during idling in normal operation when it is determined that the internal combustion engine has completed the start, and the idle time advance control condition determination means determines that the condition for the idle time advance control is met. This can prevent a reduction in rotational speed of the engine during idling immediately after completion of the start and maintain the rotation of the engine, thereby allowing idling immediately after the start of the engine to be stabilized in a short time even in cold climates or the like where the rotation of the engine becomes unstable.

The idle time advance control is performed only when the predetermined idle time advance control condition is met (in the above example, when the condition is met that the number of ignitions in the idle time advance controlling ignition position does not exceed the set value), thereby preventing the idling speed immediately after the start to be unnecessarily increased.

In the embodiment, as shown in FIG. 12, the two start time ignition positions: the first start time ignition position $\theta_{igs1}$ near the top dead center position, and the second start time ignition position (the ignition position suitable as the ignition position during idling) $\theta_{igs2}$ advanced from the first start time ignition position are set as the ignition positions suitable at the start, the ignition position switching rotational speed IGCHNE for switching the start time ignition positions, and the start determination speed SNCHNE for determining whether the engine is in operation at the start are set, ignition is performed in the first start time ignition position $\theta_{igs1}$ near the top dead center position when IGCHNE>rotational speed, and the ignition operation is performed in the second start time ignition position $\theta_{igs2}$ when IGCHNE≦rotational speed<SNCHNE. Thus, in the case where the engine is started by cranking using a starter motor, a kickback caused by pulsing of cranking can be prevented. However, the present invention is not limited to the case where the plurality of start time ignition positions are set, but only one ignition position suitable at the start may be set in a position near the top dead center position.

In the above described embodiment, the idle time advance control condition (the condition for permitting the idle time advance control) is that the number of ignitions in the idle time advance controlling ignition position does not exceed the set value, but the idle time advance control condition may be that time for the idle time advance control does not exceed a set time, or the rotational speed of the engine does not exceed a set speed in the idle time advance control.

Figure 13:
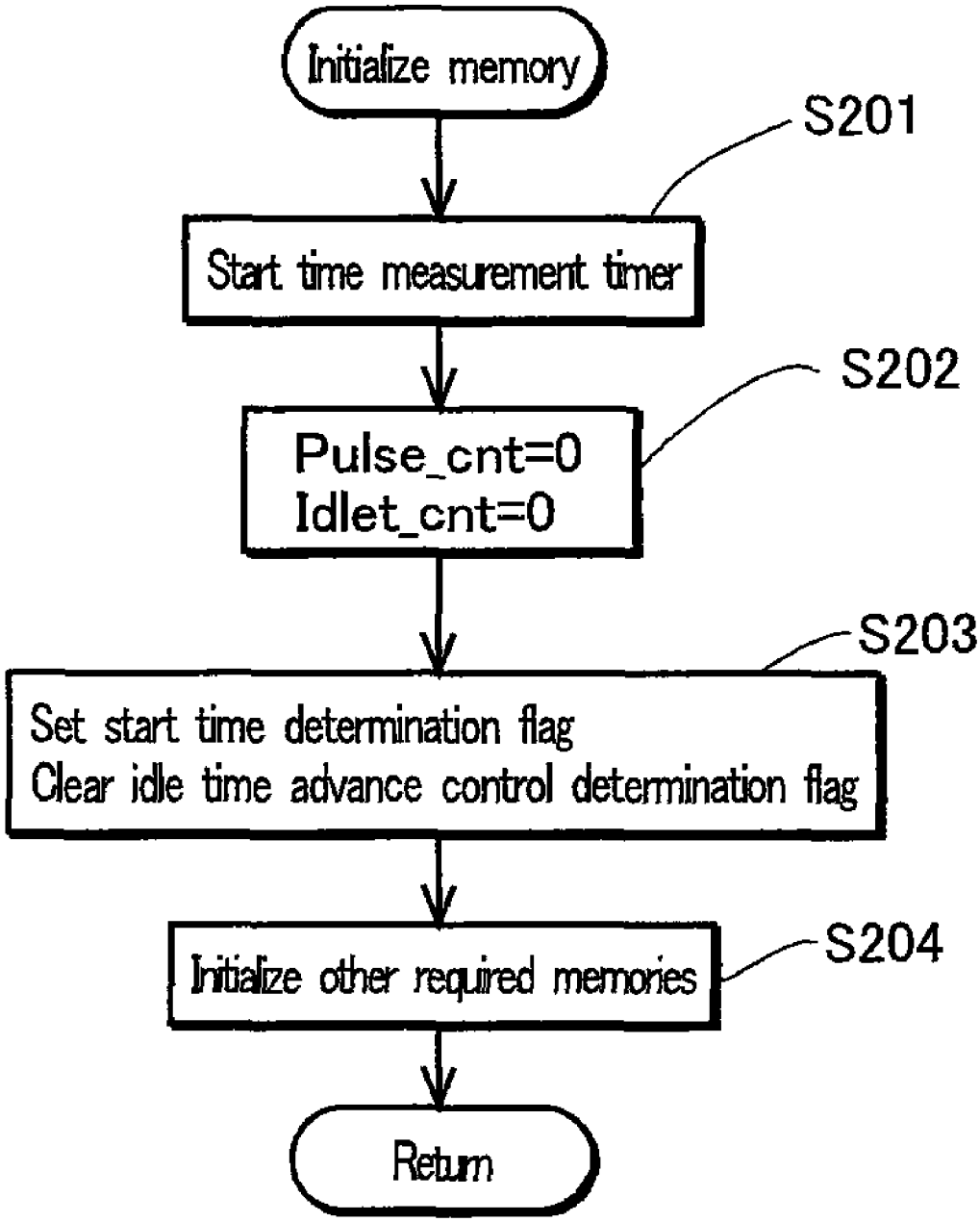
FIG. 13 is a flowchart showing an algorithm of a memory initialization processing performed immediately after activation of a microprocessor in a second embodiment of the present invention.
Figure 14:
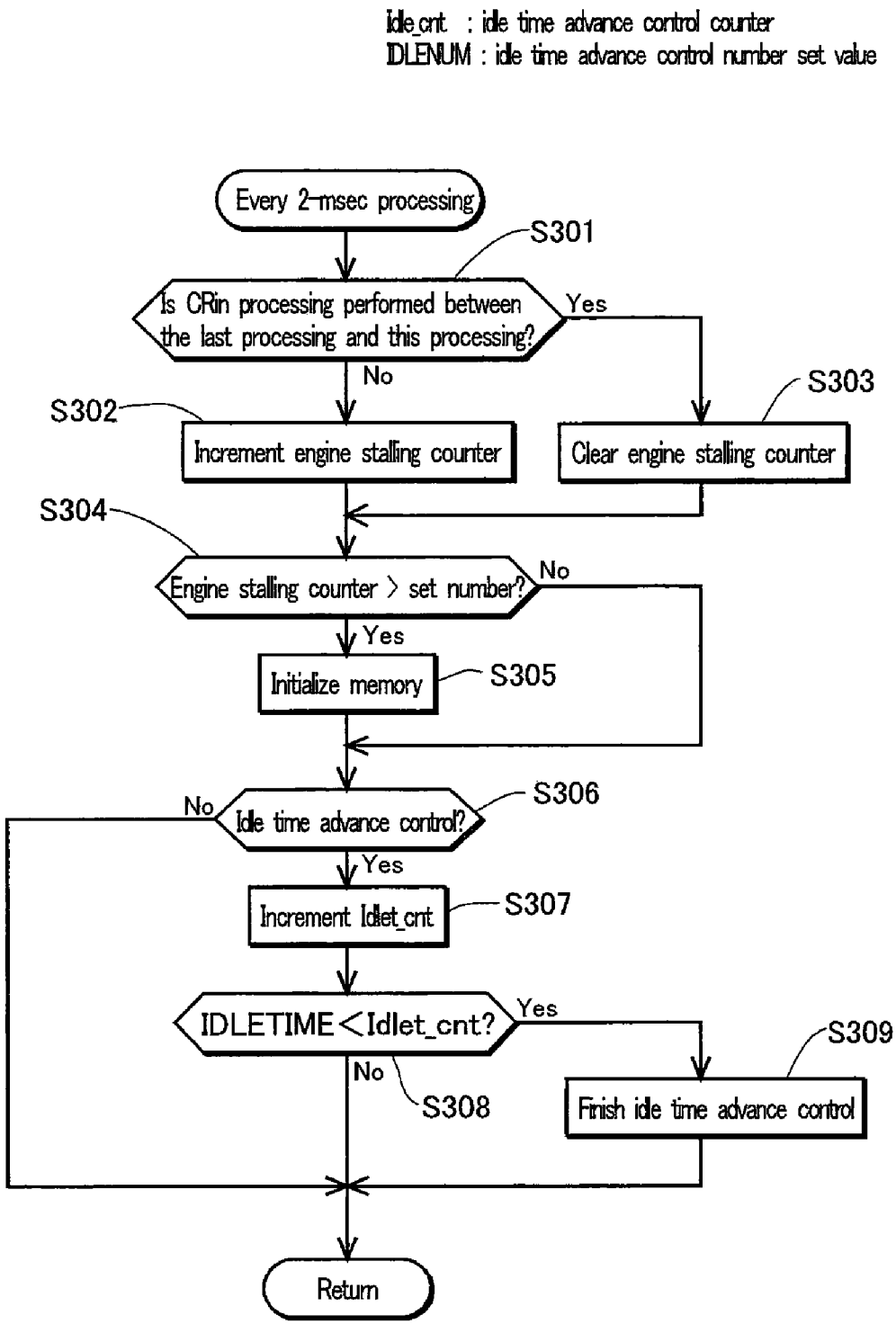
FIG. 14 is a flowchart showing an algorithm of a processing performed by the microprocessor every 2 msec in the second embodiment of the present invention.
Figure 15:
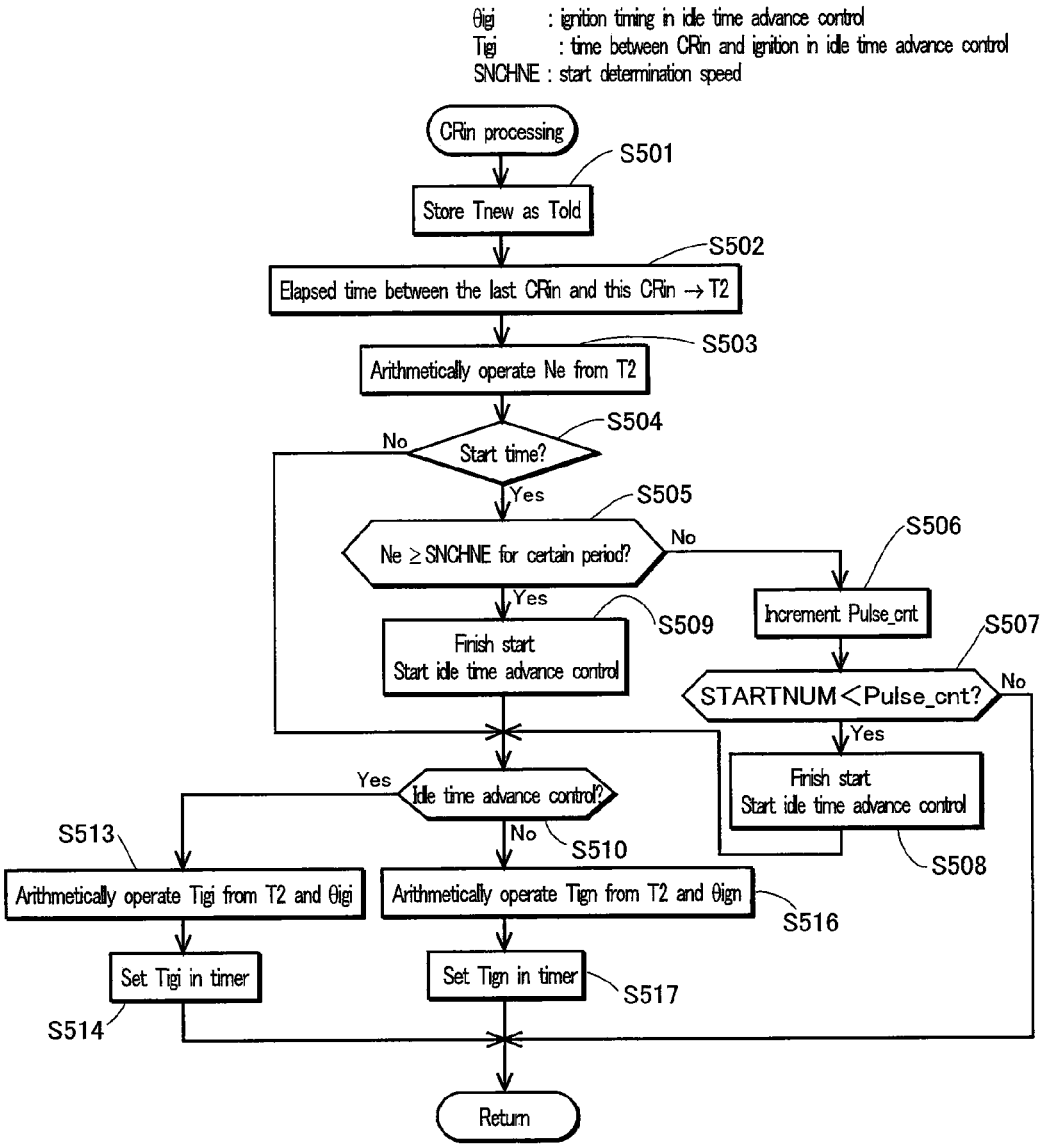
FIG. 15 is a flowchart showing an algorithm of a $CR_{in}$ processing performed by the microprocessor for each detection of a generation position $CR_{in}$ of a first negative voltage output by an exciter coil in the second embodiment of the present invention.

FIGS. 13 to 15 show algorithms of processings performed by a microprocessor in a second embodiment of the present invention in which an idle time advance control condition is that time for idle time advance control does not exceed a set time. FIG. 13 is a flowchart showing an algorithm of a memory initialization processing performed immediately after activation of the microprocessor. FIG. 14 is a flowchart showing an algorithm of an every 2-msec processing performed by the microprocessor every 2 msec in the second embodiment of the present invention. FIG. 15 is a flowchart showing an algorithm of a $CR_{in}$ processing performed by the microprocessor for each detection of a generation position $CR_{in}$ of a first negative voltage output by an exciter coil in the embodiment. In the embodiment, a processing in powering up, a positive interruption processing, a negative interruption processing, and first and second $CR_{out}$ processings are the same as those in FIGS. 5, 8, 9, 11 and 12.

In the memory initialization processing in FIG. 13, in Step S203, a count value of an idle time advance control time counter Idlet_cnt is cleared. Other points of the processing in FIG. 13 are the same as in the memory initialization processing in FIG. 6.

In the every 2-msec processing in FIG. 14, processings in Steps S301 to 5305 are the same as in the every 2-msec processing in FIG. 7. After the initialization of the memory in Step S305 in FIG. 14, it is determined in Step S306 whether the present control is the idle time advance control (whether an idle time advance control flag is set). When it is determined that the present control is the idle time advance control, in Step S307, a count value Idlet_cnt of an idle time advance control time counter is incremented by one, and then in Step S308, it is determined whether Idlet_cnt>IDLETIME. When it is determined that the count value Idlet_cnt of the idle time advance control time counter is equal to or smaller than the set value IDLETIME, this processing is finished to continue the idle time advance control. When it is determined that the count value Idlet_cnt of the idle time advance control time counter exceeds the set value IDLETIME, Step S309 is performed to finish the idle time advance control.

In the $CR_{in}$ processing in FIG. 15, processings in Steps S501 to S510 are the same as those in the $CR_{in}$ processing in FIG. 10. When it is determined in Step S510 in FIG. 15 that the present control is the idle time advance control, the process moves to Step S513, ignition position detecting counting data $T_{igi}$ is arithmetically operated from a rotational speed of the engine detected from a generation cycle $T_2$ of a first negative voltage $V_{n1}$ and an idle time advance controlling ignition position $\theta_{igi}$, and in Step S514, the ignition position detecting counting data $T_{igi}$ is set in the ignition timer, and the $CR_{in}$ processing is finished. When it is determined in Step S510 that the present control is not the idle time advance control, in Step S516, the ignition position detecting counting data $T_{ign}$ is arithmetically operated from the generation cycle $T_2$ of the first negative voltage and an ignition position $\theta_{ign}$ in normal operation having been arithmetically operated. In Step S517, the counting data $T_{ign}$ is set in the ignition timer, and the $CR_{in}$ processing is finished.

In this embodiment, idle time advance control condition determination means 27 is comprised by Step S308 of the every 2-msec processing in FIG. 14. Ignition position detecting counting data arithmetical operation means 34 for the idle time advance control is comprised by Step S513 of the $CR_{in}$ processing in FIG. 15, and ignition timer control means 35 is comprised by Step S514.

Figure 16:
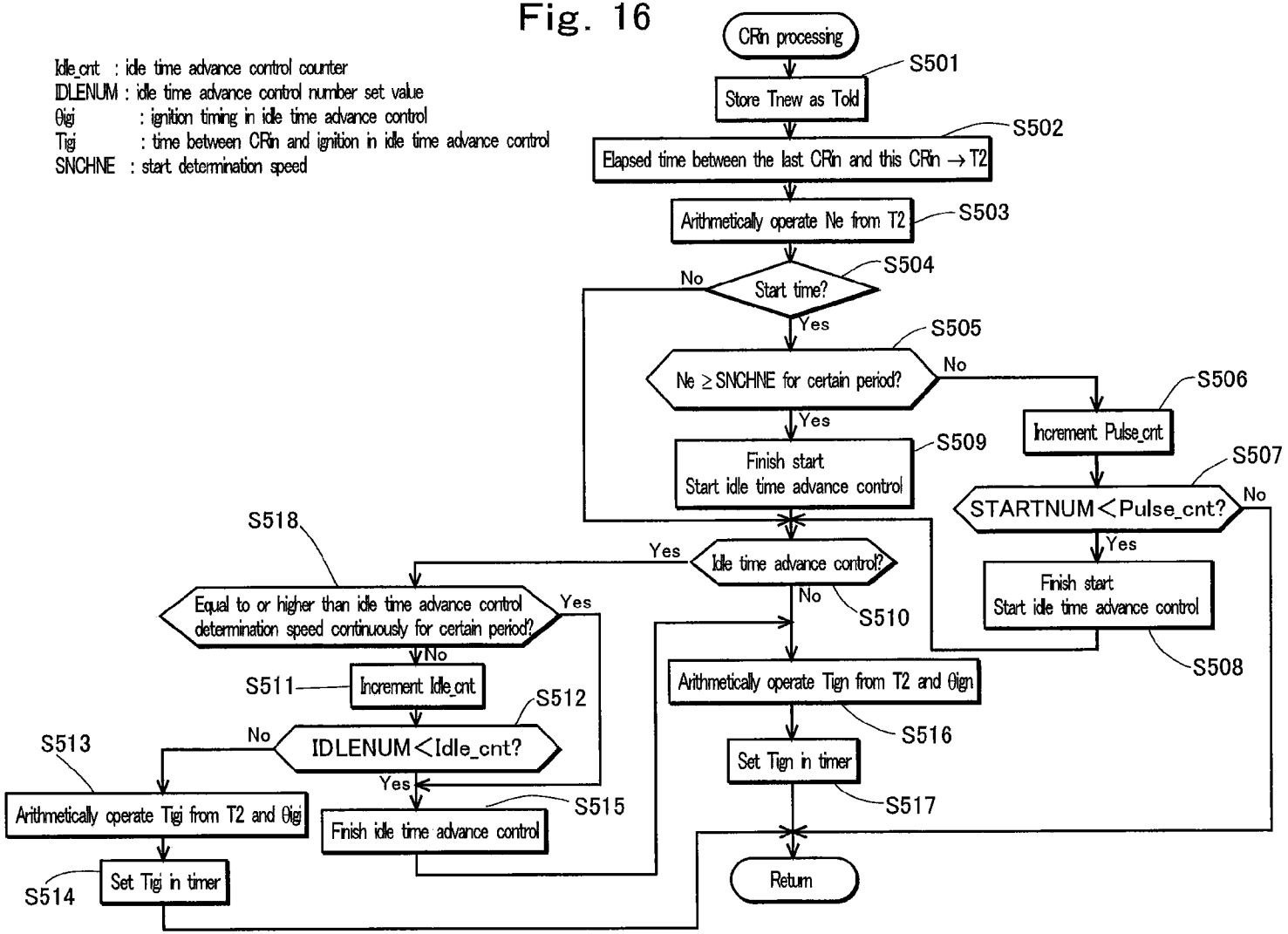
FIG. 16 is a flowchart showing an algorithm of a $CR_{in}$ processing performed by a microprocessor for each detection of a generation position $CR_{in}$ of a first negative voltage output by an exciter coil in a third embodiment of the present invention.

FIG. 16 shows an algorithm of a $CR_{in}$ processing performed by a microprocessor for each generation of a first negative voltage $V_{n1}$ by an exciter coil in a third embodiment of the present invention. Algorithms of a processing in powering up, a memory initialization processing, an every 2-msec processing, a positive interruption processing, a negative interruption processing, and first and second $CR_{out}$ processings are the same as those in FIGS. 5, 6, 7, 8, 9, 11 and 12.

The $CR_{in}$ processing in FIG. 16 is the $CR_{in}$ processing in FIG. 10 with an addition of Step S518. According to the $CR_{in}$ processing in FIG. 16, when it is determined in Step S510 that the present control is idle time advance control, it is determined in Step S518 whether a rotational speed of the engine is equal to or higher than an idle time advance control determination speed continuously for a set certain period. When it is determined that the period in which the rotational speed of the engine is continuously equal to or higher than the idle time advance control determination speed does not reach the certain period, the process proceeds to Step S511 where a count value Idle_cnt of an idle time advance control counter is incremented by one. When it is determined in Step S518 that the period in which the rotational speed of the engine is continuously equal to or higher than the idle time advance control determination speed reaches the certain period, the process moves to Step S515, and the idle time advance control is finished. Other points are the same as those in the $CR_{in}$ processing in FIG. 12.

In this embodiment, idle time advance control condition determination means 27 is comprised by Steps S518, S511 and S512. The idle time advance control condition determination means determines that an idle time advance control condition is met when the period in which the rotational speed of the internal combustion engine is continuously equal to or higher than the idle time advance control determination speed does not reach the certain period, and the count value Idle_cnt of the idle time advance control counter is equal to or smaller than an idle time advance control number set value IDLENUM, and determines that the idle time advance control condition is no longer met when the period in which the rotational speed of the internal combustion engine is continuously equal to or higher than the idle time advance control determination speed reaches the certain period, and when the count value Idle_cnt of the idle time advance control counter exceeds the idle time advance control number set value IDLENUM though the period in which the rotational speed of the engine is continuously equal to or higher than the idle time advance control determination speed does not reach the certain period.

Figure 17:
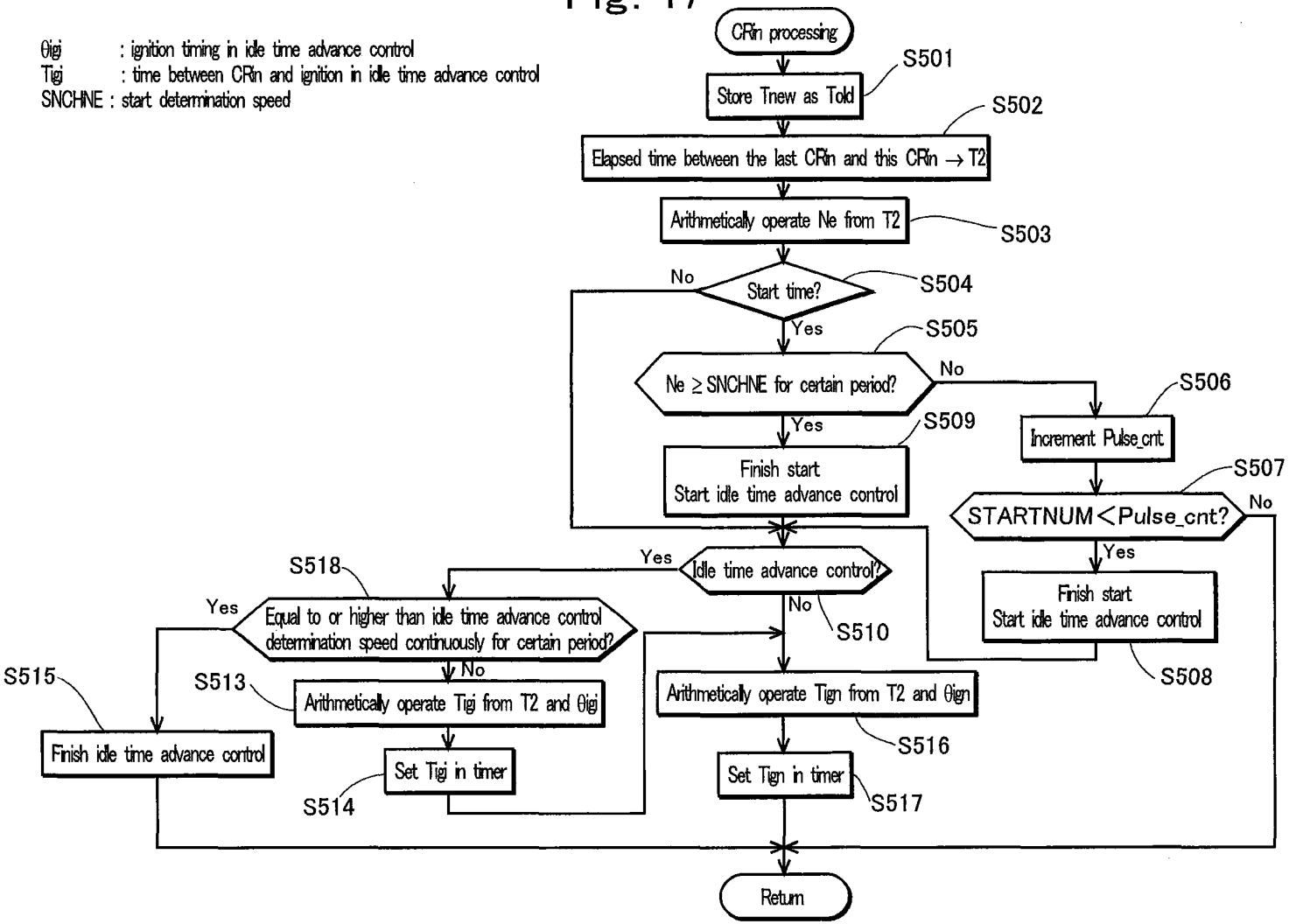
FIG. 17 is a flowchart showing an algorithm of a $CR_{in}$ processing performed by a microprocessor for each detection of a generation position $CR_{in}$ of a first negative voltage output by an exciter coil in a fourth embodiment of the present invention.

FIG. 17 shows an algorithm of a $CR_{in}$ processing performed by the microprocessor in a fourth embodiment of the present invention. In the embodiment, algorithms of a processing in powering up, a positive interruption processing, a negative interruption processing, and first and second $CR_{out}$ processings are the same as those in the first embodiment. A memory initialization processing is the same as the memory initialization processing in the second embodiment in FIG. 13, and an every 2-msec processing is the same as the every 2-msec processing in the second embodiment in FIG. 14.

The $CR_{in}$ processing in FIG. 17 is such that Steps S511 and S512 are omitted from the $CR_{in}$ processing in FIG. 16, and when it is determined in Step S518 that the period in which the rotational speed of the engine is continuously equal to or higher than the idle time advance control determination speed does not reach the certain period, the process moves to Step S513 where ignition position detecting counting data $T_{igi}$ in the idle time advance control is arithmetically operated, and when it is determined in Step S518 that the period in which the rotational speed of the engine is continuously equal to or higher than the idle time advance control determination speed reaches the certain period, the process moves to Step S515 where the idle time advance control is finished. Other points are the same as those in the $CR_{in}$ processing in the first embodiment.

When the $CR_{in}$ processing is comprised as shown in FIG. 17, idle time advance control condition determination means 27 is comprised so as to determine that an idle time advance control condition is met when the period in which the rotational speed of the internal combustion engine is continuously equal to or higher than the idle time advance control determination speed does not reach the certain period, and determine that the idle time advance control condition is no longer met when the period in which the rotational speed of the engine is continuously equal to or higher than the idle time advance control determination speed reaches the certain period.

As in the third embodiment, the idle time advance control is performed only when the period in which the rotational speed of the internal combustion engine is continuously equal to or higher than the idle time advance control determination speed does not reach the certain period, and the number of ignitions by the idle time advance control means is equal to or smaller than the set value, or as shown in the fourth embodiment, the idle time advance control is performed only until the rotational speed of the internal combustion engine is equal to or higher than the idle time advance control determination speed continuously for the set determination time. Thus, the idle time advance control can reliably prevent a rapid increase in the rotational speed of the engine, thereby allowing the idling immediately after the start of the engine to be stabilized in a short time without providing uncomfortable feeling to a driver.

Figure 18:
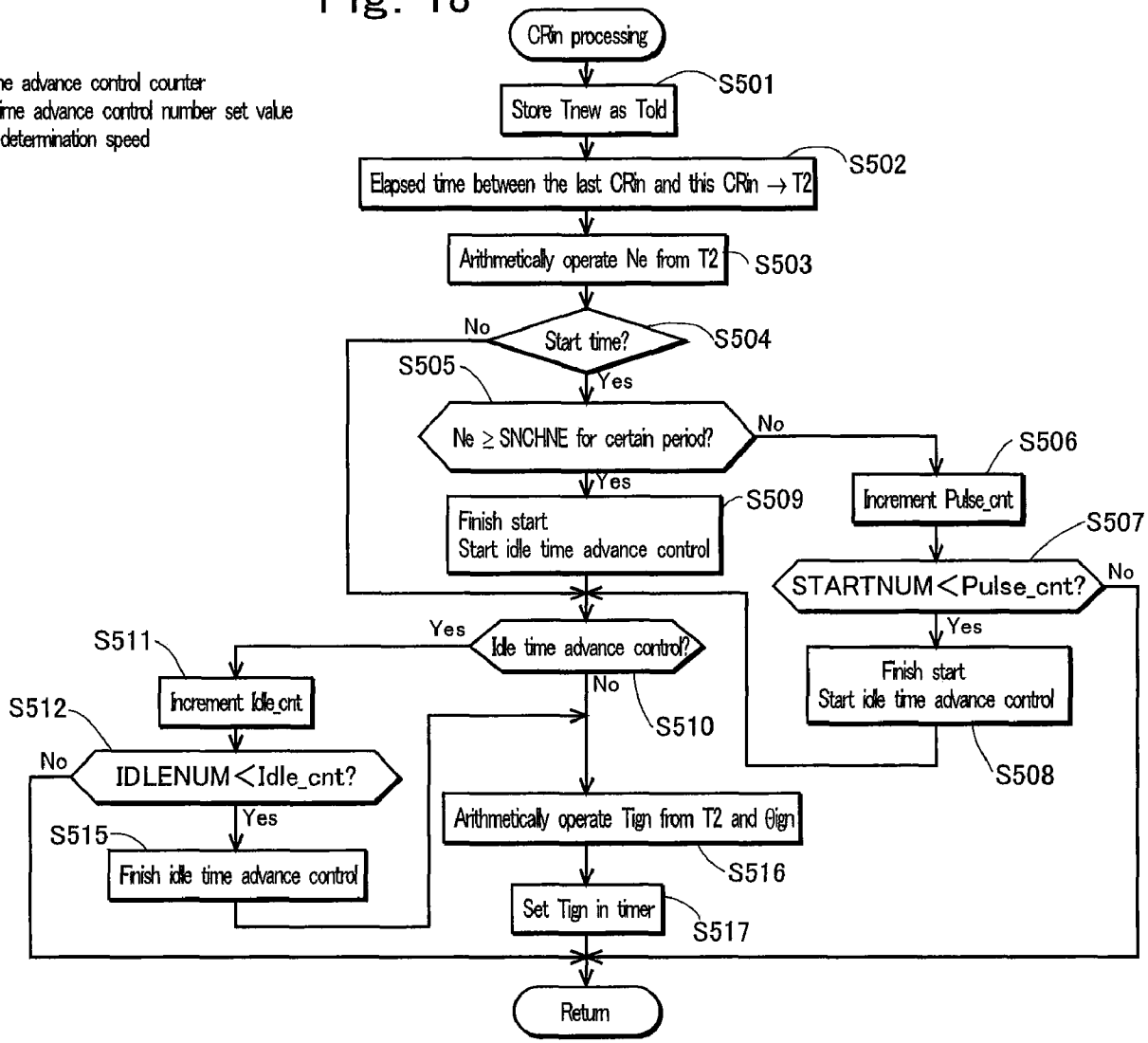
FIG. 18 is a flowchart showing an algorithm of a $CR_{in}$ processing performed by a microprocessor for each detection of a generation position $CR_{in}$ of a first negative voltage output by an exciter coil in a fifth embodiment of the present invention.
Figure 19:
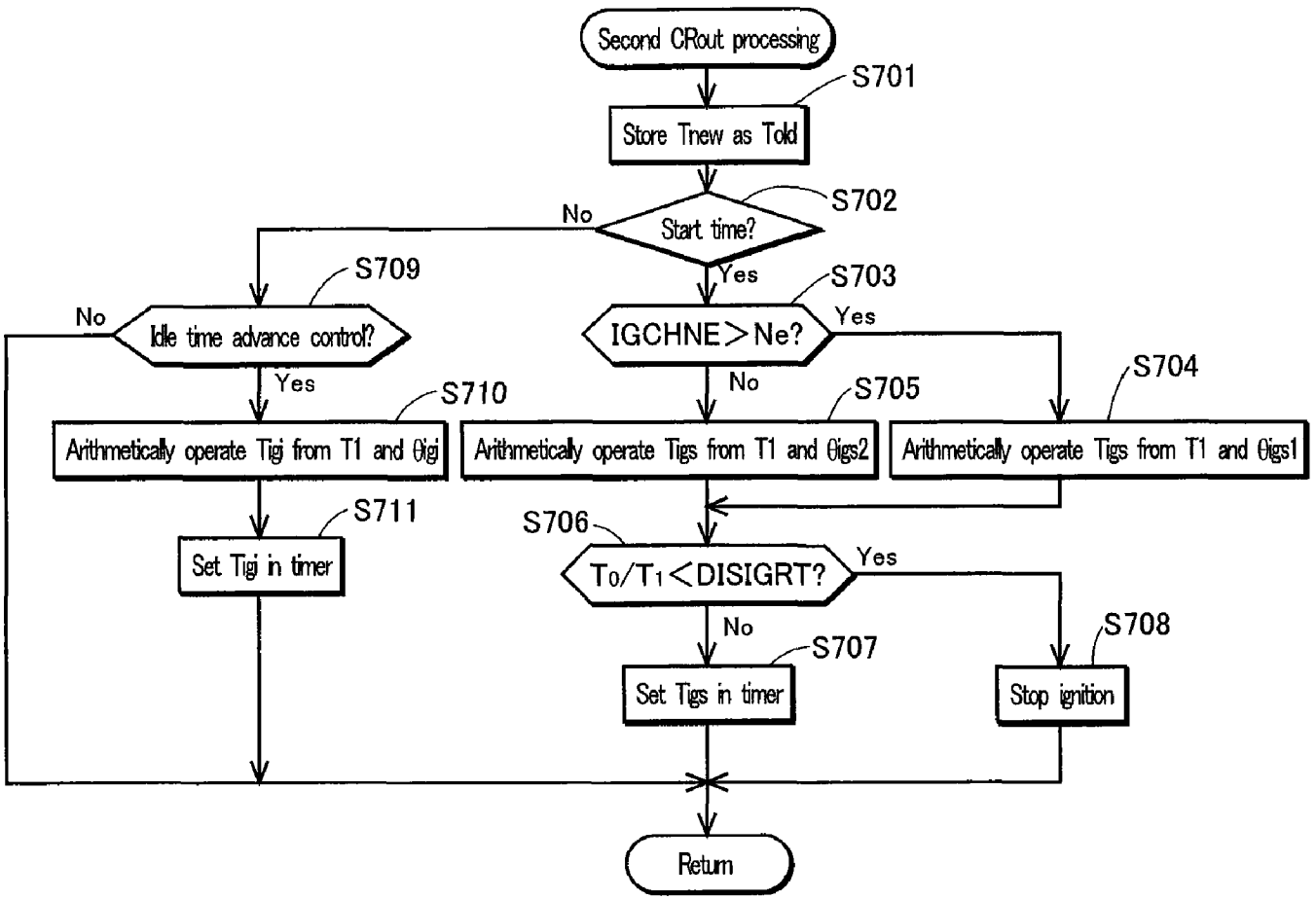
FIG. 19 is a flowchart showing an algorithm of a second $CR_{out}$ processing performed by the microprocessor for each detection of a generation position $CR_{out}$ of a second negative voltage output by the exciter coil in the fifth embodiment of the present invention.

FIGS. 18 and 19 show algorithms of a $CR_{in}$ processing and a second $CR_{out}$ processing performed by a microprocessor in a fifth embodiment of the present invention. In the embodiment, algorithms of a processing in powering up, a memory initialization processing, an every 2-msec processing, a positive interruption processing, a negative interruption processing, and first and second $CR_{out}$ processings are the same as those in the first embodiment in FIGS. 5, 6, 7, 8, 10 and 11. In the embodiment, a generation position of a second negative voltage $V_{n2}$ is set in a position advanced from an idle angle controlling ignition position.

The $CR_{in}$ processing in FIG. 18 is such that Steps S513 and S514 are omitted from the $CR_{in}$ processing in FIG. 10. In the $CR_{in}$ processing in FIG. 18, only Step S511 where a count value Idle_cnt of an idle time advance control counter is incremented, and a process of performing idle time advance control when the count value Idle_cnt of the idle time advance control counter is equal to or smaller than an idle time advance control number set value IDLENUM, and finishing the idle time advance control when the count value Idle_cnt of the idle time advance control counter exceeds the idle time advance control number set value IDLENUM are performed. Specifically, in the $CR_{in}$ processing in this embodiment, only the determination of the start and the finish of the idle time advance control is performed.

In the second $CR_{out}$ processing in FIG. 19, when it is determined in Step S702 that the engine is not at the start, Step S709 is performed and it is determined whether the present control is the idle time advance control (whether an idle time advance control flag is set). When it is determined that the present control is the idle time advance control, Step 710 is performed, and ignition position detecting counting data $T_{igi}$ in the idle time advance control is arithmetically operated from time $T_1$ between generation of a first negative voltage $V_{n1}$ and generation of a second negative voltage $V_{n2}$, and an idle time advance controlling ignition position $\theta_{igi}$, and in Step S711, the arithmetically operated ignition position detecting counting data $T_{igi}$ is immediately set in an ignition timer. Other points are the same as those in the first embodiment.

As shown in FIG. 19, when the generation position of the second negative voltage $V_{n2}$ is set in a position advanced from the idle time advance controlling ignition position $\theta_{igi}$, and measurement of the ignition position detecting counting data $T_{igi}$ in the idle time advance control is started in the generation position of the second negative voltage $V_{n2}$, time between setting the ignition position detecting counting data $T_{igi}$ in the ignition timer and performing the ignition operation can be reduced, and thus the influence of pulsing of rotation of the engine can be reduced, thereby allowing the idle time advance controlling ignition position to be precisely determined, and allowing the idle time advance control to be properly performed.

In the embodiment in FIGS. 18 and 19, idle time advance control condition determination means 27 is comprised by Step S512 in FIG. 18, and idle time advance controlling ignition position detecting counting data arithmetical operation means 34 and ignition timer control means 35 are comprised by Steps S710 and S711, respectively, in FIG. 19.

In each of the above described embodiments, the two start time ignition positions: the first start time ignition position $\theta_{igs1}$ near the top dead center position, and the second start time ignition position (the ignition position suitable as the ignition position during idling) $\theta_{igs2}$ advanced from the first start time ignition position are set as the ignition positions suitable at the start, the ignition position switching rotational speed IGCHNE for switching the start time ignition positions, and the start determination speed SNCHNE for determining whether the engine is in operation at the start are set, ignition is performed in the first start time ignition position $\theta_{igs1}$ near the top dead center position when IGCHNE>rotational speed, and the ignition operation is performed in the second start time ignition position $\theta_{igs2}$ when IGCHNE≦rotational speed<SNCHNE. Thus, in the case where the engine is started by cranking using a starter motor, a kickback caused by pulsing of cranking can be prevented. However, the present invention is not limited to the case where the plurality of start time ignition positions are set as described above, but only one ignition position suitable at the start may be set in a position near the top dead center position.

In the example in FIG. 1, the rectangular wave signal $V_{qn}$ is used having the waveform with the trailing edge from an H-level to an L-level when the exciter coil generates the negative voltage. However, it may be, of course, allowed that a rectangular wave signal $V_{qn}$ is generated having a waveform with a leading edge from an L-level to an H-level when the exciter coil generates the negative voltage, and the leading edge of the rectangular wave signal is used to detect the generation of the negative voltage.

Figure 2B:
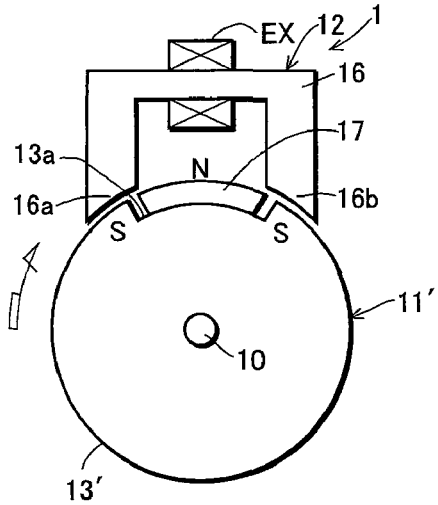

In the above described embodiment, as shown in FIG. 2(A), the magnet type AC generator is used including the flywheel magnet rotor 11 in which the permanent magnets and the magnetic path forming member are molded in the flywheel of nonmagnetic material to form the two-pole magnetic field. However, as shown in FIG. 2(B), the present invention may be applied to the case where a magnet type AC generator 1 is used including a flywheel magnet rotor 11' in which a permanent magnet 17 is secured in a recess 13*a* formed in an outer periphery of an iron flywheel 13', and the permanent magnet is magnetized radially of the flywheel to form a three-pole magnetic field, and a stator 12 in which an exciter coil EX is wound around a Π-shaped iron core 16 having, at opposite ends, magnetic pole portions 16*a* and 16*b* facing magnetic poles of the magnetic field.

In the embodiment in FIG. 3, the ignition permission and prevention means is provided in the start time ignition control means 26, but may be omitted.

In each of the above described embodiment, in the $CR_{in}$ processing, the number of rotations Pulse_cnt of the crankshaft from the commencement of the start of the engine is compared with the set number STARTNUM, and the control is shifted to control in normal operation when the number of rotations Pulse_cnt exceeds the set number STARTNUM even if the rotational speed of the engine does not reach the start determination speed. However, in the $CR_{in}$ processing, it may be allowed that Steps S506 and S507 are omitted, and it is determined whether the operation state of the engine is at the start or in normal operation simply by determining whether the rotational speed of the engine reaches the start determination speed without comparison between the number of rotations Pulse_cnt and the set number STARTNUM.

In the above described embodiments, the processing by the exciter coil in the generation position $CR_{out}$ of the second negative voltage $V_{n2}$ is performed even after the internal combustion engine becomes in normal operation, but software or hardware may be comprised so that the processing in the generation position $CR_{out}$ of the second negative voltage $V_{n2}$ is not performed after the engine becomes in normal operation.

In the above described embodiments, the number of rotations of the crankshaft from the commencement of the start operation is detected by counting the number of detections of the generation position $CR_{in}$ of the first negative voltage $V_{n1}$, but the number of rotations of the crankshaft from the commencement of the start operation may be detected by counting the number of detections of the generation position $CR_{out}$ of the second negative voltage $V_{n2}$.

The invention claimed is:

1. An ignition device for an internal combustion engine comprising:

an exciter coil that is provided in an AC generator that rotates in synchronism with the internal combustion engine, and generates an AC voltage once for one rotation of a crankshaft of said internal combustion engine, the AC voltage having a half wave of a positive voltage and a half wave of first and second negative voltages generated before and after the half wave of the positive voltage;

an ignition capacitor provided on a primary side of an ignition coil and charged to one polarity by said positive voltage;

a discharge switch that conducts when receiving an ignition signal and discharges charges accumulated in said ignition capacitor through a primary coil of said ignition coil;

a power supply circuit that charges a power supply capacitor with the first and second negative voltages of said exciter coil to generate a control DC voltage; and an ignition control portion that controls an ignition position of said internal combustion engine using a microprocessor that operates using the DC voltage output by said power supply circuit as a power supply voltage, wherein said ignition control portion comprises:

counting operation start means for causing a timer to start a counting operation when an output of said power supply circuit is established and said microprocessor starts operation;

negative voltage determination means for determining whether a negative voltage output by said exciter coil is a first negative voltage or a second negative voltage when the negative voltage is detected; and start time ignition control means for arithmetically operating time required for said internal combustion engine to rotate from a crank angle position where said second negative voltage is detected to an ignition position suitable at the start of said engine at a rotational speed calculated from time between detection of said first negative voltage and detection of the second negative voltage when said internal combustion engine is at the start, as ignition position detecting counting data, when said second negative voltage is detected, and controlling a generation position of said ignition signal so that the ignition position of said internal combustion engine is set in a crank angle position suitable at the start by immediately starting measurement of the arithmetically operated ignition position detecting counting data, said start time ignition control means is comprised so as to determine, when a negative voltage is initially detected after the commencement of a start operation of said internal combustion engine, whether said initially detected negative voltage is the first negative voltage or the second negative voltage, and when determining that the negative voltage is the second negative voltage, arithmetically operate said ignition position detecting counting data regarding a measurement value of said timer as the time between detection of said first negative voltage and detection of the second negative voltage.

2. The ignition device for an internal combustion engine according to any one of claim 1, wherein said start time ignition control means comprises ignition permission and prevention means for unconditionally permitting generation of said ignition signal when the internal combustion engine is in an initial state at the start, permitting generation of the ignition signal at said start when the internal combustion engine is no longer in the initial state at the start, and a ratio $T_0/T_1$ between time $T_0$ between detection of said second negative voltage and detection of the next first negative voltage and time $T_1$ between detection of said first negative voltage and detection of the second negative voltage is equal to or larger than a set value, and preventing the generation of the ignition signal at said start when the internal combustion engine is no longer in the initial state at the start, and said ratio $T_0/T_1$ is smaller than the set value.

3. The ignition device for an internal combustion engine according to any one of claim 1, wherein said start time ignition control means comprises ignition permission and prevention means for unconditionally permitting generation of said ignition signal when the internal combustion engine is in the initial state at the start, permitting generation of the ignition signal at said start when the internal combustion engine is no longer in the initial state at the start, and the time $T_1$ between detection of said first negative voltage and detection of the second negative voltage is equal to or shorter than a set value, and preventing the generation of the ignition signal at said start when the internal combustion engine is no longer in the initial state at the start, and said time $T_1$ exceeds the set value.

4. The ignition device for an internal combustion engine according to any one of claim 1, wherein said negative voltage determination means comprises means for setting a positive voltage detection flag when said positive voltage is detected, and clearing said positive voltage detection flag after the generation of the negative voltage, and is comprised so as to determine that the negative voltage detected without said flag being set is the first negative voltage, and that the negative voltage detected with said flag being set is the second negative voltage.

5. The ignition device for an internal combustion engine according to any one of claim 1, wherein said negative voltage determination means comprises start time initial determination means for determining whether said internal combustion engine is in the initial state at the start, first determination means for determining whether the negative voltage is the first negative voltage or the second negative voltage when said start time initial determination means determines that said internal combustion engine is in the initial state at the start, and second determination means for determining whether the negative voltage is the first negative voltage or the second negative voltage when said start time initial determination means determines that said internal combustion engine is no longer in the initial state at the start, said first determination means comprises means for setting a positive voltage detection flag when said positive voltage is detected and clearing said positive voltage detection flag after the negative voltage is detected, and is comprised so as to determine that the negative voltage detected without said flag being set is the first negative voltage, and that the negative voltage detected with said flag being set is the second negative voltage, said second determination means is comprised so as to compare an elapsed time $T_{old}$ measured last time by elapsed time measurement means with an elapsed time $T_{new}$ detected this time, the elapsed time measurement means reading a measurement value of a timer that measures an elapsed time for each detection of each negative voltage and measuring an elapsed time between detection of the last negative voltage and detection of this negative voltage, determine that the negative voltage detected this time is the first negative voltage when the relationship of $T_{new}<T_{old}/k$ (k is a constant equal to or larger than one) is not met, and determine that the negative voltage detected this time is the second negative voltage when the relationship of $T_{new}<T_{old}/k$ is met.

6. The ignition device for an internal combustion engine according to claim 5, wherein said start time initial determination means is comprised so as to determine that said internal combustion engine is in the initial state at the start when the number of ignition operations performed after the commencement of the start operation of said internal combustion engine is smaller than a set value, and determines that said internal combustion engine is no longer in the initial state at the start when the number of ignition operations performed after the commencement of the start operation of said internal combustion engine is equal to or larger than the set value.

7. The ignition device for an internal combustion engine according to claim 5, wherein said start time initial determination means is comprised so as to determine that said internal combustion engine is in the initial state at the start when the rotational speed of the internal combustion engine calculated from time between detection of said first negative voltage and detection of the second negative voltage is lower than a set value, and determines that said internal combustion engine is no longer in the initial state at the start when the rotational speed of the internal combustion engine calculated from time between detection of said first negative voltage and detection of the second negative voltage is equal to or higher than the set value.

8. The ignition device for an internal combustion engine according to any one of claim 1, wherein a capacitance and a charging time constant of the power supply capacitor of said power supply circuit are set so that an output voltage of said power supply circuit reaches a level required for operating said microprocessor until the negative voltage initially induced in said exciter coil at the start of said internal combustion engine reaches its peak.

9. An ignition device for an internal combustion engine comprising:

an exciter coil that is provided in an AC generator that rotates in synchronism with the internal combustion engine, and generates an AC voltage once for one rotation of a crankshaft of said internal combustion engine, the AC voltage having a half wave of a positive voltage and a half wave of first and second negative voltages generated before and after the half wave of the positive voltage;

an ignition capacitor provided on a primary side of an ignition coil and charged to one polarity by said positive voltage;

a discharge switch that conducts when receiving an ignition signal and discharges charges accumulated in said ignition capacitor through a primary coil of said ignition coil;

a power supply circuit that charges a power supply capacitor with the first and second negative voltages of said exciter coil to generate a control DC voltage; and an ignition control portion that controls an ignition position of said internal combustion engine using a microprocessor that operates using the DC voltage output by said power supply circuit as a power supply voltage, wherein said ignition control portion comprises:

counting operation start means for causing a timer to start a counting operation when an output of said power supply circuit is established and said microprocessor starts operation;

ignition signal generation means comprising an ignition timer that measures ignition position detecting counting data for generating said ignition signal when said ignition timer completes the measurement of the ignition position detecting counting data;

negative voltage determination means for determining whether a negative voltage output by said exciter coil is a first negative voltage or a second negative voltage when the negative voltage is detected;

start completion determination means for determining whether said internal combustion engine is at the start or has completed the start;

start time ignition control means for arithmetically operating time required for said internal combustion engine to rotate from a detection position of said second negative voltage to an ignition position suitable at the start of the engine at a rotational speed of said internal combustion engine calculated from time between detection of said first negative voltage and detection of the second negative voltage and an angle between the detection position of said first negative voltage and the detection position of the second negative voltage when said start completion determination means determines that the internal combustion engine is at the start, as ignition position detecting counting data, when it is determined that the negative voltage detected by said negative voltage determination means is the second negative voltage, and controlling the ignition position of said internal combustion engine to the position suitable at the start by causing said ignition timer to immediately start measurement of the arithmetically operated ignition position detecting counting data;

idle time advance control condition determination means for determining whether an idle time advance control condition is met that is a condition for permitting idle time advance control to advance an ignition position during idling immediately after completion of the start of said internal combustion engine from an ignition position during idling in normal operation in order to stabilize idling immediately after completion of the start of said internal combustion engine;

idle time advance control means for controlling the generation position of said ignition signal so that when said idle time advance control condition determination means determines that the idle time advance control condition is met, the ignition position during idling immediately after completion of the start of said internal combustion engine is advanced from the ignition position during idling in normal operation; and normal operation time ignition control means for controlling the generation position of said ignition signal so that when said start completion determination means determines that said internal combustion engine has completed the start, and said idle time advance control condition determination means determines that the idle time advance control condition is not met, said ignition position is set in a position suitable in normal operation of said internal combustion engine, said start time ignition control means is comprised so as to arithmetically operate, when said negative voltage determination means determines that the negative voltage initially detected after the commencement of the start operation of said internal combustion engine is the second negative voltage, said ignition position detecting counting data regarding a measurement value of the timer in initial detection of said negative voltage as time between detection of said first negative voltage and detection of the second negative voltage.

10. The ignition device for an internal combustion engine according to claim 9, wherein said start completion determination means is comprised so as to determine that said internal combustion engine is at the start when the rotational speed of said internal combustion engine is lower than a start determination speed, and determine that said internal combustion engine has completed said start when the rotational speed of said internal combustion engine is equal to or higher than said start determination speed continuously for a certain period.

11. The ignition device for an internal combustion engine according to claim 9, wherein said start completion determination means is comprised so as to determine that said internal combustion engine is at the start when the rotational speed of the internal combustion engine is lower than the start determination speed, and the number of rotations of the crankshaft of said engine after the commencement of the start operation of the internal combustion engine is equal to or smaller than a set number, and determine that said internal combustion engine has completed the start when the rotational speed of said internal combustion engine is equal to or higher than the start determination speed continuously for a certain period, and when the number of rotations of the crankshaft of said engine after the commencement of the start operation of said internal combustion engine exceeds said set number though the rotational speed of said internal combustion engine is lower than the start determination speed, said set number is set to a value corresponding to the maximum number of rotations of the crankshaft when cranking is manually performed in a state where said internal combustion engine cannot be started.

12. The ignition device for an internal combustion engine according to any one of claim 9, wherein said idle time advance control condition determination means is comprised so as to determine that the idle time advance control condition is met when the number of ignitions by said idle time advance control means is equal to or smaller than a set value, and determine that the idle time advance control condition is not met when the number of ignitions by said idle time advance control means exceeds the set value.

13. The ignition device for an internal combustion engine according to any one of claim 9, wherein said idle time advance control condition determination means is comprised so as to determine that the idle time advance control condition is met when an elapsed time from the start of control of the ignition position by said idle time advance control means is equal to or shorter than a set time, and determine that the idle time advance control condition is not met when the elapsed time from the start of control of the ignition position by said idle time advance control means exceeds the set time.

14. The ignition device for an internal combustion engine according to any one of claim 9, wherein said idle time advance control condition determination means is comprised so as to determine that the idle time advance control condition is met when a period in which the rotational speed of said internal combustion engine is continuously equal to or higher than an idle time advance control determination speed does not reach a set certain period, and determine that the idle time advance control condition is no longer met when the period in which the rotational speed of said internal combustion engine is continuously equal to or higher than the idle time advance control determination speed reaches the set certain period.

15. The ignition device for an internal combustion engine according to any one of claim 9, wherein said idle time advance control condition determination means is comprised so as to determine that said idle time advance control condition is met when a period in which the rotational speed of said internal combustion engine is continuously equal to or higher than a set idle time advance control determination speed does not reach a set certain period, and when the number of ignitions by said idle time advance control means is equal to or smaller than a set value, and determine that the idle time advance control condition is no longer met when the period in which the rotational speed of the internal combustion engine is continuously equal to or higher than said idle time advance control determination speed reaches the certain period, and when the number of ignitions by the idle time advance control means reaches the set value though the period in which the rotational speed of the internal combustion engine is continuously equal to or higher than the idle time advance control determination speed does not reach the certain period.

16. The ignition device for an internal combustion engine according to any one of claim 9, wherein said idle time advance control means is comprised so as to arithmetically operate time required for said internal combustion engine to rotate, at an idling speed of said internal combustion engine calculated from a cycle of detection of said first negative voltage, from the detection position of said first negative voltage to an ignition position in idle time advance control set in a position advanced from the ignition position at the idling speed in normal operation of said internal combustion engine, as said ignition position detecting counting data, in the generation position of said second negative voltage, and control the ignition position of said internal combustion engine to be advanced from the ignition position during idling in normal operation by causing said ignition timer to immediately start measurement of the arithmetically operated ignition position detecting counting data.

17. The ignition device for an internal combustion engine according to any one of claim 9, wherein said idle time advance control means is comprised so as to arithmetically operate time required for said internal combustion engine to rotate, at an idling speed of said internal combustion engine calculated from time between detection of said first negative voltage and detection of the second negative voltage and an angle between the detection position of said first negative voltage and the detection position of the second negative voltage, from the detection position of said second negative voltage to an ignition position in idle time advance control set in a position advanced from the ignition position at the idling speed in normal operation of said internal combustion engine, as ignition position detecting counting data in idle time advance control, in the detection position of said second negative voltage, and control the ignition position of said internal combustion engine to be advanced from the ignition position during idling in normal operation by causing said ignition timer to immediately start measurement of the arithmetically operated ignition position detecting counting data.

18. The ignition device for an internal combustion engine according to any one of claim 9, wherein said normal operation time ignition control means is comprised so as to perform a process of arithmetically operating an ignition position in normal operation of said internal combustion engine arithmetically operated with respect to the rotational speed of said internal combustion engine calculated from a generation cycle of said first negative voltage, and time required for the engine to rotate from the generation position of said first negative voltage to the arithmetically operated ignition position in normal operation at the rotational speed of said internal combustion engine calculated from the generation cycle of said first negative voltage, as ignition position detecting counting data in normal operation, and a process of causing said ignition timer to start the measurement of the ignition position detecting counting data in normal operation, when said first negative voltage is detected.

* * * * *